US011167341B2

(12) United States Patent
Yu et al.

(10) Patent No.: US 11,167,341 B2
(45) Date of Patent: Nov. 9, 2021

(54) CLUSTER FOR CASTING GOLF CLUB HEADS

(71) Applicant: Taylor Made Golf Company, Inc, Carlsbad, CA (US)

(72) Inventors: Joseph Yu, Kaohsiung (TW); Bing-Ling Chao, San Diego, CA (US)

(73) Assignee: TAYLOR MADE GOLF COMPANY, INC., Carlsbad, CA (US)

( * ) Notice: Subject to any disclaimer, the term of this patent is extended or adjusted under 35 U.S.C. 154(b) by 0 days.

(21) Appl. No.: 16/237,295

(22) Filed: Dec. 31, 2018

(65) Prior Publication Data

US 2020/0147677 A1 May 14, 2020

Related U.S. Application Data

(63) Continuation-in-part of application No. 16/189,515, filed on Nov. 13, 2018.

(51) Int. Cl.

| | |
|---|---|
| ***B22D 13/10*** | (2006.01) |
| ***B22D 13/04*** | (2006.01) |
| ***A63B 53/04*** | (2015.01) |

(52) U.S. Cl.

CPC ..... *B22D 13/101* (2013.01); *A63B 53/047* (2013.01); *B22D 13/04* (2013.01)

(58) Field of Classification Search

CPC .. B22D 13/101; B22D 13/04; B22D 11/0403; B22D 11/0405; B22D 11/103; B22C 9/082

See application file for complete search history.

(56) References Cited

U.S. PATENT DOCUMENTS

| | | | | |
|---|---|---|---|---|
| 4,754,969 | A * | 7/1988 | Kobayashi | A63B 53/0466 473/290 |
| 5,224,705 | A * | 7/1993 | Scheie | A63B 53/047 473/291 |
| 5,836,830 | A * | 11/1998 | Onuki | A63B 53/047 473/349 |
| 6,773,360 | B2 | 8/2004 | Willett et al. | |

(Continued)

FOREIGN PATENT DOCUMENTS

| | | | |
|---|---|---|---|
| CN | 2673540 | Y | 1/2005 |
| JP | 62275557 | A * | 11/1987 |
| JP | 08289945 | | 11/1996 |

OTHER PUBLICATIONS

U.S. Appl. No. 11/528,989, filed Sep. 27, 2006.

*Primary Examiner* — Kevin P Kerns
*Assistant Examiner* — Steven S Ha
(74) *Attorney, Agent, or Firm* — Kunzler Bean & Adamson

(57) ABSTRACT

Disclosed herein is a casting cluster for casting a body of a golf club head made of titanium or a titanium alloy. The casting cluster comprises a receptor and a plurality of runners coupled to the receptor and configured to receive molten metal from the receptor. The casting cluster also includes at least forty main gates. At least two of the main gates are coupled to each of the runners and each main gate is configured to receive molten metal from a corresponding one of the plurality of runners. The casting cluster further comprises at least forty molds. Each mold of the at least forty molds is configured to receive molten metal from a corresponding one of the main gates and to cast a body of an iron-type golf club head.

23 Claims, 19 Drawing Sheets

(56) References Cited

U.S. PATENT DOCUMENTS

| | | | |
|---|---|---|---|
| 6,830,093 | B2 | 12/2004 | Bramley |
| 6,852,038 | B2 | 2/2005 | Yabu |
| 7,166,040 | B2 | 1/2007 | Bing-Ling et al. |
| 7,186,190 | B1 | 3/2007 | Beach et al. |
| 7,223,180 | B2 | 5/2007 | Willett et al. |
| 7,267,620 | B2 | 9/2007 | Chao et al. |
| 7,407,447 | B2 | 8/2008 | Beach et al. |
| 7,410,425 | B2 | 8/2008 | Willett et al. |
| 7,410,426 | B2 | 8/2008 | Willett et al. |
| 7,419,441 | B2 | 9/2008 | Hoffman et al. |
| 7,448,963 | B2 | 11/2008 | Beach et al. |
| 7,452,285 | B2 | 11/2008 | Bing-Ling et al. |
| 7,513,296 | B1 | 4/2009 | Yu et al. |
| 7,530,904 | B2 | 5/2009 | Beach et al. |
| 7,540,811 | B2 | 6/2009 | Beach et al. |
| 7,568,985 | B2 | 8/2009 | Beach et al. |
| 7,578,753 | B2 | 8/2009 | Beach et al. |
| 7,591,738 | B2 | 9/2009 | Beach et al. |
| 7,621,823 | B2 | 11/2009 | Beach et al. |
| 7,628,707 | B2 | 12/2009 | Beach et al. |
| 7,632,194 | B2 | 12/2009 | Beach et al. |
| 7,713,142 | B2 | 5/2010 | Hoffman et al. |
| 7,717,804 | B2 | 5/2010 | Beach et al. |
| 7,717,805 | B2 | 5/2010 | Beach et al. |
| 7,744,484 | B1 | 6/2010 | Bing-Ling et al. |
| 7,775,905 | B2 | 8/2010 | Beach et al. |
| 7,846,041 | B2 | 12/2010 | Beach et al. |
| 7,874,936 | B2 | 1/2011 | Chao et al. |
| 7,874,937 | B2 | 1/2011 | Chao et al. |
| 7,963,861 | B2 | 6/2011 | Beach et al. |
| RE42,544 | E | 7/2011 | Chao et al. |
| 7,985,146 | B2 | 7/2011 | Lin et al. |
| 8,025,587 | B2 | 9/2011 | Beach et al. |
| 8,096,897 | B2 | 1/2012 | Beach et al. |
| 8,235,831 | B2 | 8/2012 | Beach et al. |
| 8,235,844 | B2 | 8/2012 | Albertson et al. |
| 8,241,143 | B2 | 8/2012 | Albertson et al. |
| 8,241,144 | B2 | 8/2012 | Albertson et al. |
| 8,303,431 | B2 | 11/2012 | Beach et al. |
| 8,337,319 | B2 | 12/2012 | Sargent et al. |
| 8,444,505 | B2 | 5/2013 | Beach et al. |
| 8,628,434 | B2 | 1/2014 | Chao et al. |
| 8,734,271 | B2 | 5/2014 | Beach et al. |
| 8,870,678 | B2 | 10/2014 | Beach et al. |
| 8,888,607 | B2 | 12/2014 | Harbert et al. |
| 8,900,069 | B2 | 12/2014 | Beach et al. |
| 9,033,821 | B2 | 5/2015 | Beach et al. |
| 9,174,096 | B2 | 11/2015 | Sargent et al. |
| 9,220,953 | B2 | 12/2015 | Beach et al. |
| 9,259,625 | B2 | 2/2016 | Sargent et al. |
| 9,662,545 | B2 | 5/2017 | Beach et al. |
| 10,046,212 | B2 | 8/2018 | Sargent et al. |
| 2004/0106466 | A1* | 6/2004 | Wieland ..... A63B 53/047 473/349 |
| 2004/0229714 | A1* | 11/2004 | Wahl ..... A63B 53/047 473/345 |
| 2005/0239575 | A1 | 10/2005 | Chao et al. |
| 2008/0149267 | A1 | 6/2008 | Chao et al. |
| 2009/0163289 | A1 | 6/2009 | Chao et al. |
| 2011/0152000 | A1 | 6/2011 | Sargent et al. |
| 2011/0312437 | A1 | 12/2011 | Sargent et al. |
| 2012/0071264 | A1 | 3/2012 | Beach et al. |
| 2012/0122601 | A1 | 5/2012 | Beach et al. |
| 2012/0258818 | A1 | 10/2012 | Beach et al. |
| 2013/0123040 | A1 | 5/2013 | Willett et al. |
| 2013/0217514 | A1 | 8/2013 | Sugimoto |
| 2016/0175666 | A1 | 6/2016 | Chao et al. |
| 2020/0147676 | A1 | 5/2020 | Yu et al. |

* cited by examiner

| | |
|---|---|
| R max (m) | 0.2 |
| R min (m) | NA |
| Major runner cross section | 21mm<br>23mm |
| Main gate cross section | 20mm<br>25mm |
| Runner cross sectional area ($m^2$) | 0.000475 |
| Wet perimeter (m) | 0.0873 |
| Gate cross sectional area ($m^2$) | 0.000489 |
| Interface gating ratio (%) runner to gate | 102.87% |
| R (flow radius) of runner (m) | 0.0054 |
| Rotation (mm) | 500 |
| Shell preheat temp ($^0$C) | 600 |
| Angular speed (rad/sec) | 52.36 |
| Pouring material (kg) | 11 |
| Casting Pieces | 40 |
| Process loss (kg) | 1.9 |

FIG. 6A

| | |
|---|---|
| Actual available filling material (kg) | 9.1 |
| Material usage (kg/pc) (w/o process loss) | 0.275 |
| Material usage (kg/pc) (w/ process loss) | 0.228 |
| Process loss ratio | 17.1% |
| Velocity max (m/s) | 10.47 |
| Velocity min (m/s) | NA |
| Acceleration max ($m/s^2$) | 548.28 |
| Acceleration min ($m/s^3$) | NA |
| Force max (Nt) | 124.73 |
| Force min (Nt) | NA |
| Pressure max (Pa) | 262353.77 |
| Pressure min (Pa) | NA |
| Kinetic energy max (J) | 12.47 |
| Density (MP) ($g/cm^2$) | 4.11 |
| Viscosity (MP) ($g/cm^2sec$) | 0.033 |
| Renumber max | 284174.21 |
| Renumber min | NA |

FIG. 6B

CLUSTER FOR CASTING GOLF CLUB HEADS

CROSS-REFERENCE TO RELATED APPLICATION

This is a continuation-in-part application of U.S. patent application Ser. No. 16/189,515, filed Nov. 13, 2018, which is incorporated herein by reference in its entirety.

FIELD

This disclosure relates generally to golf club heads of golf clubs, and more particularly to casting clusters and corresponding processes for manufacturing golf club heads.

BACKGROUND

Iron-type golf clubs (e.g., irons) typically includes a hollow shaft and an iron-type golf club head coupled to a lower end of the shaft. Most modern versions of club heads are made, at least in part, from a lightweight but strong metal, such as a steel alloy and/or a titanium alloy. Iron-type golf club heads include various types, such as blade, muscle-back, cavity-back, and hollow body. Each type of golf club head includes a face portion with a front surface, known as a strike face, configured to contact the golf ball during a proper golf swing.

Some iron-type golf club heads are made by urging molten material into a mold cavity in a process commonly called casting. Often, multiple mold cavities form part of a casting cluster or casting tree. Casting clusters facilitate the manufacture of multiple iron-type golf club heads at the same time. However, the more mold cavities added to a casting cluster, the greater the force necessary to urge the molten material fully and completely into the mold cavity. Conventional casting clusters for casting iron-type golf club heads have reached maximum limits on the number of iron-type golf club heads manufactured at the same time. Moreover, many conventional casting clusters and corresponding techniques produce iron-type golf club heads at low yield and high material usage rates. Accordingly, casting high quantities of iron-type golf club heads at the same time, at high yields, and low material usage can be difficult.

SUMMARY

The subject matter of the present application has been developed in response to the present state of the art, and in particular, in response to the shortcomings of casting techniques for golf club heads that have not yet been fully solved by currently available techniques. Accordingly, the subject matter of the present application has been developed to provide a cluster and corresponding casting technique that overcome at least some of the above-discussed shortcomings of prior art techniques.

Disclosed herein is a casting cluster for casting a body of a golf club head made of titanium or a titanium alloy. The casting cluster comprises a receptor and a plurality of runners coupled to the receptor and configured to receive molten metal from the receptor. The casting cluster also includes at least forty main gates. At least two of the main gates are coupled to each of the runners and each main gate is configured to receive molten metal from a corresponding one of the plurality of runners. The casting cluster further comprises at least forty molds. At least two of the at least forty molds are coupled to each one of the plurality of runners via respective main gates of the at least forty main gates. Each mold of the at least forty molds is configured to receive molten metal from a corresponding one of the main gates. Each mold of the at least forty molds is configured to cast a body of an iron-type golf club head having a volume of no more than 80 $cm^3$. The preceding subject matter of this paragraph characterizes example 1 of the present disclosure.

The plurality of runners comprises at least sixteen runners. The preceding subject matter of this paragraph characterizes example 2 of the present disclosure, wherein example 2 also includes the subject matter according to example 1, above.

Each runner of the plurality of runners comprises a proximal end, adjacent the receptor, and a distal end, opposite the proximal end. One main gate and one mold are coupled to the distal end of each of the plurality of runners. At least one main gate and at least one mold are coupled to each of the plurality of runners between the proximal end and the distal end of the corresponding runner. The preceding subject matter of this paragraph characterizes example 3 of the present disclosure, wherein example 3 also includes the subject matter according to any one of examples 1-2, above.

Each runner of the plurality of runners comprises a top surface and a bottom surface, opposite the top surface. The at least one main gate and the at least one mold coupled to each of the plurality of runners between the proximal end and the distal end are coupled to the bottom surface of the corresponding runner. The preceding subject matter of this paragraph characterizes example 4 of the present disclosure, wherein example 4 also includes the subject matter according to example 3, above.

At least two main gates and at least two molds are coupled to each of the plurality of runners between the proximal end and the distal end of the corresponding runner. One of the at least two main gates and one of the at least two molds are coupled to the bottom surface of the corresponding runner. Another one of the at least two main gates and another one of the at least two molds are coupled to the top surface of the corresponding runner. The preceding subject matter of this paragraph characterizes example 5 of the present disclosure, wherein example 5 also includes the subject matter according to example 4, above.

Each runner of the plurality of runners comprises a top surface and a bottom surface, opposite the top surface. The at least one main gate and the at least one mold coupled to each of the plurality of runners at the location between the proximal end and the distal end are coupled to the top surface of the corresponding runner. The preceding subject matter of this paragraph characterizes example 6 of the present disclosure, wherein example 6 also includes the subject matter according to any one of examples 3-5, above.

Each runner of the plurality of runners comprises a proximal end, adjacent the receptor, and a distal end, opposite the proximal end. At least two main gates and at least two molds are coupled to each of the plurality of runners between the proximal end and the distal end of the corresponding runner. The preceding subject matter of this paragraph characterizes example 7 of the present disclosure, wherein example 7 also includes the subject matter according to any one of examples 1-6, above.

Each runner of the plurality of runners comprises a top surface and a bottom surface, opposite the top surface. One of the at least two main gates and one of the at least two molds are coupled to the bottom surface of the corresponding runner. Another one of the at least two main gates and another one of the at least two molds are coupled to the top surface of the corresponding runner. The preceding subject matter of this paragraph characterizes example 8 of the present disclosure, wherein example 8 also includes the subject matter according to example 7, above.

Each runner of the plurality of runners comprises a top surface and a bottom surface, opposite the top surface. The at least two main gates and the at least two molds are coupled to the bottom surface of the corresponding runner. The preceding subject matter of this paragraph characterizes example 9 of the present disclosure, wherein example 9 also includes the subject matter according to any one of examples 7-8, above.

Each runner of the plurality of runners comprises a top surface and a bottom surface, opposite the top surface. The at least two main gates and the at least two molds are coupled to the top surface of the corresponding runner. The preceding subject matter of this paragraph characterizes example 10 of the present disclosure, wherein example 10 also includes the subject matter according to any one of examples 7-9, above.

One mold coupled to each of the plurality of runners is configured to cast a body having a first size or a first shape. Another mold coupled to each of the plurality of runners is configured to cast a body having a second size, different than the first size, or a second shape, different than the first shape. The preceding subject matter of this paragraph characterizes example 11 of the present disclosure, wherein example 11 also includes the subject matter according to any one of examples 1-10, above.

The body having the first size corresponds with the body of a blade-type, muscle-back-type, or cavity-back type iron golf club head. The body having the second size corresponds with the body of a hollow-body-type iron golf club head. The preceding subject matter of this paragraph characterizes example 12 of the present disclosure, wherein example 12 also includes the subject matter according to example 11, above.

The body having the first size corresponds with the body of a players-iron-type golf club head. The body having the second size corresponds with the body of a game-improvement-iron golf club head. The preceding subject matter of this paragraph characterizes example 13 of the present disclosure, wherein example 13 also includes the subject matter according to any one of examples 11 or 12, above At least three of the main gates are coupled to each of a plurality of the runners. The preceding subject matter of this paragraph characterizes example 14 of the present disclosure, wherein example 14 also includes the subject matter according to any one of examples 1-13, above.

The casting cluster further comprises at least forty-two main gates and at least forty-two molds. At least two of the at least forty-two molds are coupled to each one of the plurality of runners via respective main gates of the at least forty-two main gates. The preceding subject matter of this paragraph characterizes example 15 of the present disclosure, wherein example 15 also includes the subject matter according to any one of examples 1-14, above.

The plurality of runners comprises at least twenty-one runners. The preceding subject matter of this paragraph characterizes example 16 of the present disclosure, wherein example 16 also includes the subject matter according to example 15, above.

The casting cluster further comprises at least fifty-two main gates and at least fifty-two molds. At least two of the at least fifty-two molds are coupled to each one of the plurality of runners via respective main gates of the at least fifty-two main gates. The preceding subject matter of this paragraph characterizes example 17 of the present disclosure, wherein example 17 also includes the subject matter according to any one of examples 1-16, above.

The plurality of runners comprises at least twenty-six runners. The preceding subject matter of this paragraph characterizes example 18 of the present disclosure, wherein example 18 also includes the subject matter according to example 17, above.

Each mold of the at least forty molds is configured to cast a body that has a mass of approximately 0.228 kilograms. The preceding subject matter of this paragraph characterizes example 19 of the present disclosure, wherein example 19 also includes the subject matter according to any one of examples 1-18 above.

The casting cluster is configured to produce a cast-product yield of at least 80%. The preceding subject matter of this paragraph characterizes example 20 of the present disclosure, wherein example 20 also includes the subject matter according to any one of examples 1-19, above.

Each of the at least forty main gates and the corresponding runner, to which each of the at least forty main gates are coupled, have an interface gating ratio of approximately 1.3. The preceding subject matter of this paragraph characterizes example 21 of the present disclosure, wherein example 21 also includes the subject matter according to any one of examples 1-20, above.

The body of the golf club head, cast by each mold, comprises an entirety of a face portion of the iron-type golf club head. The preceding subject matter of this paragraph characterizes example 22 of the present disclosure, wherein example 22 also includes the subject matter according to any one of examples 1-21, above.

The body of the golf club head, cast by each mold, comprises only a portion of a face portion of the iron-type golf club head. The preceding subject matter of this paragraph characterizes example 23 of the present disclosure, wherein example 23 also includes the subject matter according to any one of examples 1-22, above.

Also disclosed herein is a method of casting a body of a golf club head made of titanium or a titanium alloy. The method comprises rotating a casting cluster at a rotational speed of at least 500 rotations-per-minute (RPM). The casting cluster comprises a receptor and a plurality of runners coupled to the receptor and configured to receive molten metal from the receptor. The casting cluster also comprises at least forty main gates. At least two of the main gates are coupled to each of the runners and each main gate is configured to receive molten metal from a corresponding one of the plurality of runners. The casting cluster further comprises at least forty molds. At least two of the at least forty molds are coupled to each one of the plurality of runners via respective main gates of the at least forty main gates. Each mold of the at least forty molds is configured to receive molten metal from a corresponding one of the main gates. Each mold of the at least forty molds is configured to cast a body of an iron-type golf club head. While rotating the casting cluster, the method comprises introducing a molten titanium-based metal into the casting cluster. While rotating the casting cluster, the method comprises flowing the molten titanium-based metal through the plurality of runners, through the at least forty main gates, and into the at least forty molds. The method additionally comprises producing a cast-product yield of at least 80%. The preceding subject matter of this paragraph characterizes example 24 of the present disclosure.

The described features, structures, advantages, and/or characteristics of the subject matter of the present disclosure may be combined in any suitable manner in one or more embodiments and/or implementations. In the following description, numerous specific details are provided to impart a thorough understanding of embodiments of the subject matter of the present disclosure. One skilled in the relevant art will recognize that the subject matter of the present disclosure may be practiced without one or more of the specific features, details, components, materials, and/or methods of a particular embodiment or implementation. In other instances, additional features and advantages may be recognized in certain embodiments and/or implementations that may not be present in all embodiments or implementations. Further, in some instances, well-known structures, materials, or operations are not shown or described in detail to avoid obscuring aspects of the subject matter of the present disclosure. The features and advantages of the subject matter of the present disclosure will become more fully apparent from the following description and appended claims, or may be learned by the practice of the subject matter as set forth hereinafter.

BRIEF DESCRIPTION OF THE DRAWINGS

In order that the advantages of the subject matter may be more readily understood, a more particular description of the subject matter briefly described above will be rendered by reference to specific embodiments that are illustrated in the appended drawings. Understanding that these drawings depict only typical embodiments of the subject matter and are not therefore to be considered to be limiting of its scope, the subject matter will be described and explained with additional specificity and detail through the use of the drawings, in which:

FIG. 6A is a table of casting data obtained from six different casting clusters, according to one or more examples of the present disclosure;

FIG. 6B is another table of casting data obtained from six different casting clusters, according to one or more examples of the present disclosure;

DETAILED DESCRIPTION

The following describes embodiments of golf club heads in the context of golf club heads for drivers, fairway woods, and utility clubs (also known as hybrid clubs). However, concepts described herein may also be applicable to iron-type golf club heads unless otherwise indicated.

Figure 1:
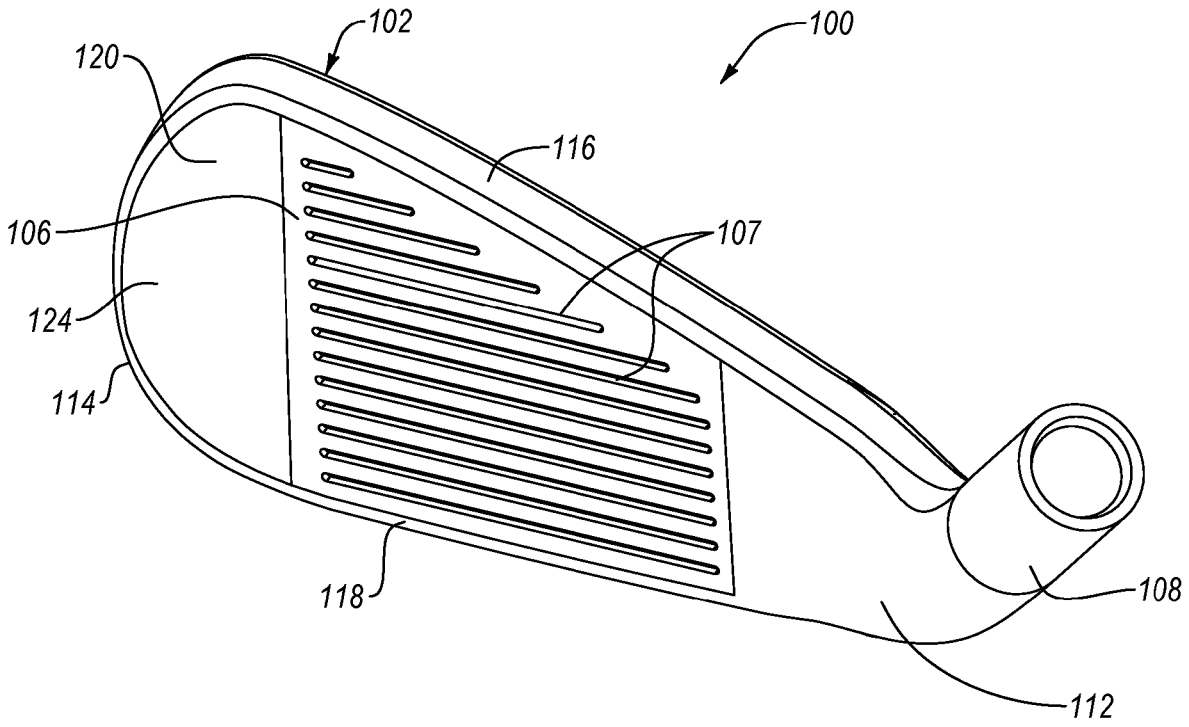
FIG. 1 is a perspective view of a golf club head, according to one or more examples of the present disclosure.

Referring to FIG. 1, the golf club head 100, according to one example of the present disclosure, has a toe portion 114, a heel portion 112, a top portion 116 (e.g., top-line portion), and a sole portion 118 (e.g., bottom portion), all defined by a body 102 of the golf club head 100. The body 102 additionally includes a hosel 108 extending from the heel portion 112. The hosel 108 is configured to receive and engage with a shaft and grip of a golf club. The shaft extends from the hosel 108 and the grip is secured to the shaft at a location on the shaft opposite that of the golf club head 100. The golf club head 100 further includes a forward portion 124 that defines a strike face 106 designed to impact a golf ball during a normal golf swing. In the example of FIG. 1, the strike face 106 is entirely defined by the body 102.

Generally, for many iron-type golf club heads, such as the golf club head 100, the strike face 106 has a planar surface that is angled relative to a ground plane when the golf club head 100 is in an address position to define a loft of the golf club head 100. In other words, the strike face 106 of an iron-type golf club head generally does not include a curved surface. Accordingly, the strike face 106 of the iron-type golf club head 100 is defined as the portion of the forward portion 124 with an outwardly facing planar surface. In other words, although the forward portion 124 may include a curved surface, the strike face 106 does not include such a curved surface. In contrast, the strike face of a metal-wood, driver, or hybrid golf club head does have a curved surface that curves around a substantially upright axis. The forward portion 124 of the golf club head 100 includes grooves 107 formed in the strike face 106 to promote desirable flight characteristics (e.g., backspin) of the golf ball upon being impacted by the strike face 106. In some implementations, the golf club head 100 of FIG. 1 is configured to be a blade iron with a minimal cavity in a rearward portion (not shown), a muscle-back iron with a minimal cavity and large weight mass in the rearward portion (not shown), or a cavity-back iron with a significant cavity in the rearward portion (see, e.g., FIG. 2).

Figure 2:
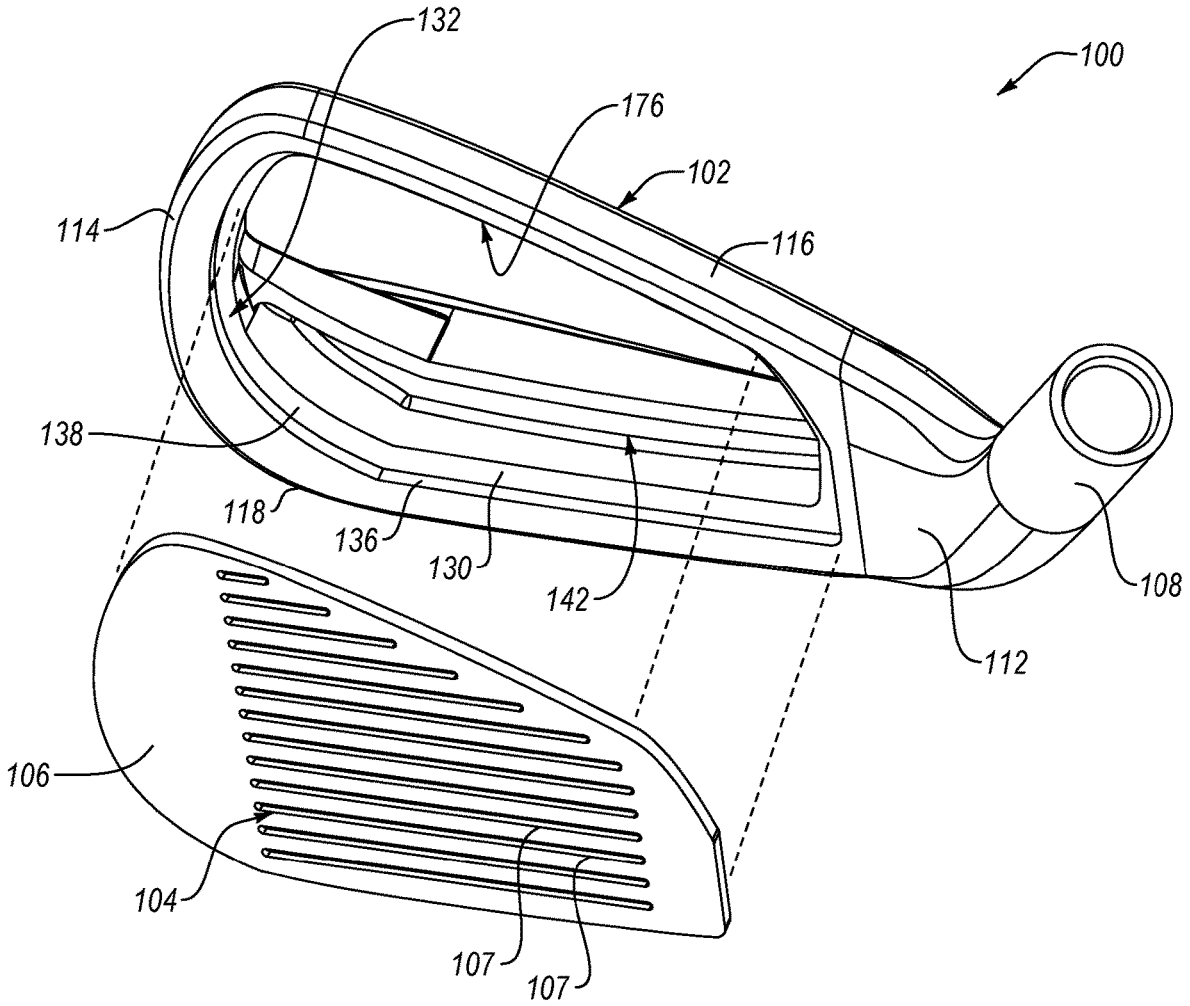
FIG. 2 is an exploded perspective view of a golf club head, with a strike plate, according to one or more examples of the present disclosure.

Referring now to FIG. 2, in some examples, at least part of the forward portion 124 of the golf club head 100 is not defined by the body 102. More specifically, in the illustrated implementation, an entirety of the strike face 106 is not defined by the body 102. Rather, an entirety of the strike face 106 is defined by a strike plate 104 that is formed separately from the body 102 and attached to the body 102. In some implementations, only a portion of the strike face 106 is defined by the strike plate 104, with the remaining portion of the strike face 106 defined by the body 102. Generally, the strike plate 104 is defined as any piece of the golf club head 100 that is attached (e.g., welded) to the body 102 of the golf club head 100 and includes at least a portion of the strike face 106. The strike plate 104 can include all or a portion of the grooves 107 of the golf club head 100.

The body 102 of the golf club head 100 of FIG. 2 also includes a plate interface 132. The plate interface 132 includes a rim 136 and a ledge 138. The rim 136 defines a surface that faces an interior of the body 102 and the ledge 138 defines a surface that faces the front of the body 102. The rim 136 is transverse relative to the ledge 138. The rim 136 is sized to be substantially flush against or just off of an outer peripheral edge 133 of the strike plate 104. The fit between the rim 136 of the plate interface 132 and the outer peripheral edge 133 of the strike plate 104 facilitates the butt welding together of the rim 136 of the body 102 and the outer peripheral edge 133 of the strike plate 104 with a peripheral weld. In other words, a peripheral weld is located between and welds together the rim 136 of the plate interface 132 and the outer peripheral edge 133 of the strike plate 104.

The strike plate 104 is formed separately from the body 102 and is separately attached to the body 102. The body 102 and the strike plate 104 can be formed using the same type of process or different types of processes. In the illustrated embodiment, the body 102 is formed to have a one-piece monolithic construction using a first manufacturing process and the strike plate 104 is formed to have a separate one-piece monolithic construction using a second manufacturing process. Additionally, the body 102 can be formed of the same material as or a different material than the strike plate 104. In one example, the body 102 is made from a first material and the strike plate 104 is made from a second material. Separately forming and attaching together the body 102 and the strike plate 104 and making the body 102 and the strike plate 104 from the same or different materials, which allows flexibility in the types of manufacturing processes and materials used, promotes the ability to make a golf club head 100 that achieves a wide range of performance, aesthetic, and economic results.

Figure 3:
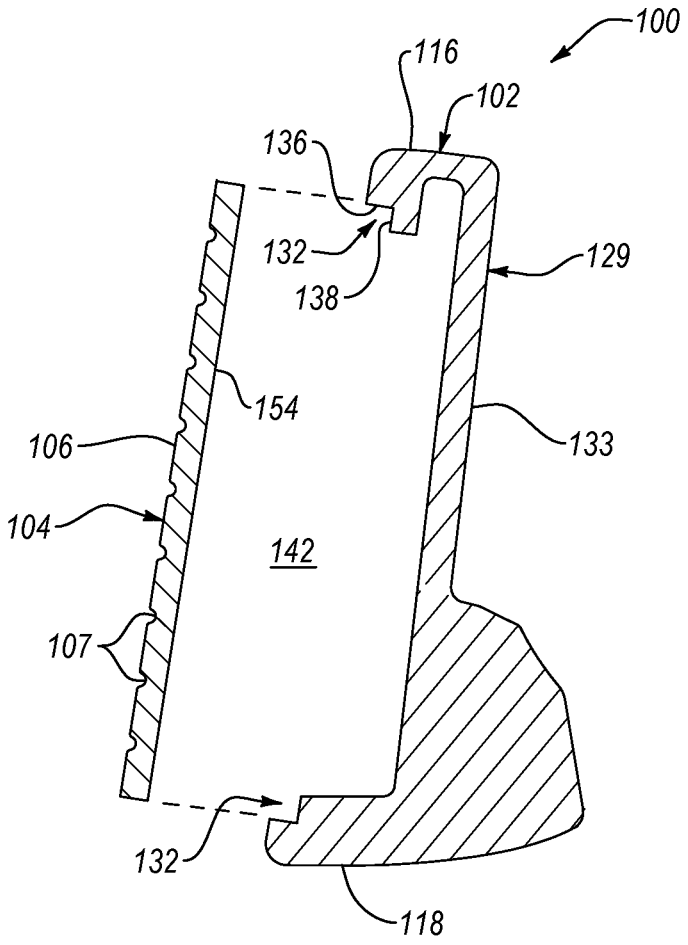
FIG. 3 is an exploded cross-sectional side view of a golf club head, with a hollow body and a strike plate, according to one or more examples of the present disclosure.

Referring to FIG. 3, the golf club head 100 is similar to the golf club head 100 of FIG. 2. For example, the golf club head 100 of FIG. 3 includes a body 102 and a separately formed strike plate 104 that is attached to the body 102. However, unlike the golf club head 100 of FIG. 2, the golf club head 100 of FIG. 3 is a hollow-cavity-type or hollow-body-type iron golf club head. More specifically, the internal cavity 142 and a back surface 154 of the strike plate 104 of the golf club head 100 of FIG. 3, when attached to the body 102, are enclosed or closed to a rear of the golf club head 100. A rearward portion 129 of the golf club head 100 further includes a rear wall 133 that encloses a rearward side of the internal cavity 142. The golf club head 100 having a hollow internal cavity 142 provides several advantages, such as an increased forgiveness for off-center hits on the strike face 106 of the strike plate 104. In some embodiments, the volume of the golf club head 100, with the strike face 104 attached, is between about 10 $cm^3$ and about 120 $cm^3$. For example, in some embodiments, the golf club head 100 has a volume between about 20 $cm^3$ and about 110 $cm^3$, such as between about 30 $cm^3$ and about 100 $cm^3$, such as between about 40 $cm^3$ and about 90 $cm^3$, such as between about 50 $cm^3$ and about 80 $cm^3$, and such as between about 60 $cm^3$ and about 80 $cm^3$. In additional embodiments, the golf club head 100 has a volume that is no more than 80 $cm^3$. In some embodiments, the golf club head 100 has an overall depth that is between about 15 mm and about 100 mm. For example, in some embodiments, the golf club head 100 has an overall depth between about 20 mm and about 90 mm, such as between about 30 mm and about 80 mm and such as between about 40 mm and about 70 mm.

Other examples of cavity-back, muscle-back, and hollow-cavity iron-type golf club heads are described in U.S. patent application Ser. No. 14/981,330, filed Dec. 28, 2015, which is incorporated herein by reference.

The body 102 of the golf club head 100 of FIGS. 1-3 has a single, one-piece, monolithic construction. Accordingly, all portions of the golf club head 100 of FIGS. 1-3 defined by the body 102 are co-formed together such that the all portions of the golf club head 100 defined by the body 102 are continuously and seamlessly coupled together. For example, all portions of the golf club head 100 of FIG. 1 defined by the body 102, including the entirety of the strike face 106, are co-cast together using a casting process, such as one described herein. As another example, all portions of the golf club head 100 of FIGS. 2 and 3 defined by the body 102, which does not include at least a portion of the strike face 106, are co-cast together using a casting process, such as one described herein.

Although not shown, the golf club head 100 may include other portions that are separately formed and coupled to a monolithically-constructed body. Such other portions can be in addition to a strike plate 104. For example, the golf club head 100 of FIG. 2 may include a rear panel that is coupled to a rearward portion 129 the body 102 over an opening in the rearward portion 129 to, in effect, enclose the interior cavity 142 instead of having a rear wall 133 co-formed as part of the body 102. The rear panel can be made of a material, such as a non-metal, that is different than the material of the body 102 or a metal, that is the same as or different than the material of the body 102.

The golf club head 100 can include any of various other features, such as slots, formed in the body 102 of the golf club head 100. For example, the body 102 may include a slot formed in the body 102 at the sole portion 118 of the golf club head 100. The slot is a groove or channel in some examples. Moreover, the slot can be a through-slot, or a slot that is open on a sole portion side of the slot and open on an interior cavity side or interior side of the slot. However, in other implementations, the slot is not a through-slot, but rather is closed on an interior cavity side or interior side of the slot. In some implementations, the slot is filled with a filler material. The filler material can be made from a non-metal, such as a thermoplastic material, thermoset material, and the like, in some implementations. However, in other implementations, the slot is not filled with a filler material, but rather maintains an open, vacant, space within the slot. Although not shown, the body 102 of the golf club head 100 may include any of various ribs or stiffeners monolithically formed or co-cast with the body 102.

All portions of the body 102, being monolithic, are made of the same material, which can be titanium or any of various titanium-based alloys. In some examples, the body 102 is made of a titanium alloy, including, but not limited to, 9-1-1 titanium, 6-4 titanium, 3-2.5, 6-4, SP700, 15-3-3-3, 10-2-3, or other alpha/near alpha, alpha-beta, and beta/near beta titanium alloys) or mixtures thereof. Titanium alloys comprising aluminum (e.g., 8.5-9.5% Al), vanadium (e.g., 0.9-1.3% V), and molybdenum (e.g., 0.8-1.1% Mo), optionally with other minor alloying elements and impurities, herein collectively referred to a "9-1-1 Ti", can have less significant alpha case, which renders HF acid etching unnecessary or at least less necessary compared to faces made from conventional 6-4 Ti and other titanium alloys. Further, 9-1-1 Ti can have minimum mechanical properties of 820 MPa yield strength, 958 MPa tensile strength, and 10.2% elongation. These minimum properties can be significantly superior to typical cast titanium alloys, such as 6-4 Ti, which can have minimum mechanical properties of 812 MPa yield strength, 936 MPa tensile strength, and ~6% elongation.

Golf club head bodies that are cast including the strike face as an integral part of the body (e.g., cast at the same time as a single cast object) can provide superior structural properties compared to club heads where the strike face is formed separately and later attached (e.g., welded or bolted) to a front opening in the club head body. However, the advantages of having an integrally cast Ti strike face are mitigated by the need to remove the alpha case on the surface of cast Ti strike faces.

With the herein disclosed club head bodies comprising an integrally cast 9-1-1 Ti strike face, the drawback of having to remove the alpha case can be eliminated, or at least substantially reduced. For a cast 9-1-1 Ti strike face, using a conventional mold pre-heat temperature of 1000 C or more, the thickness of the alpha case can be about 0.15 mm or less, or about 0.20 mm or less, or about 0.30 mm or less, such as between 0.10 mm and 0.30 mm in some embodiments, whereas for a cast 6-4 Ti strike face the thickness of the alpha case can be greater than 0.15 mm, or greater than 0.20 mm, or greater than 0.30 mm, such as from about 0.25 mm to about 0.30 mm in some examples.

In some cases, the reduced thickness of the alpha case for 9-1-1 Ti strike face portions (e.g., 0.15 mm or less) may not be thin enough to provide sufficient durability needed for a face portion and to avoid needing to etch away some of the alpha case with a harsh chemical etchant, such as HF acid. In such cases, the pre-heat temperature of the mold can be lowered (such as to less than 800 C, less than 700 C, less than 600 C, and/or less than or equal to 500 C) prior to pouring the molten titanium alloy into the mold. This can further reduce the amount of oxygen transferred from the mold to the cast titanium alloy, resulting in a thinner alpha case (e.g., less than 0.15 mm, less than 0.10 mm, and/or less than 0.07 mm). This provides better ductility and durability for the body with integral strike face, which is especially important for the forward portion.

The thinner alpha case in cast 9-1-1 Ti strike faces helps provide enhanced durability, such that the strike face is durable enough that the removal of part of the alpha case from the face via chemical etching is not needed. Thus, hydrofluoric acid etching can be eliminated from the manufacturing process when the body and strike face are unitarily cast using 9-1-1 Ti, especially when using molds with lower pre-heat temperatures. This can simplify the manufacturing process, reduce cost, reduce safety risks and operation hazards, and eliminate the possibility of environmental contamination by HF acid. Further, because HF acid is not introduced to the metal, the body with integral strike face, or even the whole club head, can comprise very little or substantially no fluorine atoms, which can be defined as less than 1000 ppm, less than 500 ppm, less than 200 ppm, and or less than 100 ppm, wherein the fluorine atoms present are due to impurities in the metal material used to cast the body.

In some examples, the body 102 is made of an alpha-beta titanium alloy comprising 6.5% to 10% Al by weight, 0.5% to 3.25% Mo by weight, 1.0% to 3.0% Cr by weight, 0.25% to 1.75% V by weight, and/or 0.25% to 1% Fe by weight, with the balance comprising Ti (one example is sometimes referred to as "1300" titanium alloy). In another representative example, the alloy may comprise 6.75% to 9.75% Al by weight, 0.75% to 3.25% or 2.75% Mo by weight, 1.0% to 3.0% Cr by weight, 0.25% to 1.75% V by weight, and/or 0.25% to 1% Fe by weight, with the balance comprising Ti. In yet another representative embodiment, the alloy may comprise 7% to 9% Al by weight, 1.75% to 3.25% Mo by weight, 1.25% to 2.75% Cr by weight, 0.5% to 1.5% V by weight, and/or 0.25% to 0.75% Fe by weight, with the balance comprising Ti. In a further representative embodiment, the alloy may comprise 7.5% to 8.5% Al by weight, 2.0% to 3.0% Mo by weight, 1.5% to 2.5% Cr by weight, 0.75% to 1.25% V by weight, and/or 0.375% to 0.625% Fe by weight, with the balance comprising Ti. In another representative embodiment, the alloy may comprise 8% Al by weight, 2.5% Mo by weight, 2% Cr by weight, 1% V by weight, and/or 0.5% Fe by weight, with the balance comprising Ti (such titanium alloys can have the formula Ti-8Al-2.5Mo-2Cr-1V-0.5Fe). As used herein, reference to "Ti-8Al-2.5Mo-2Cr-1V-0.5Fe" refers to a titanium alloy including the referenced elements in any of the proportions given above. Certain embodiments may also comprise trace quantities of K, Mn, and/or Zr, and/or various impurities.

Ti-8Al-2.5Mo-2Cr-1V-0.5Fe can have minimum mechanical properties of 1150 MPa yield strength, 1180 MPa ultimate tensile strength, and 8% elongation. These minimum properties can be significantly superior to other cast titanium alloys, including 6-4 Ti and 9-1-1 Ti, which can have the minimum mechanical properties noted above. In some embodiments, Ti-8Al-2.5Mo-2Cr-1V-0.5Fe can have a tensile strength of from about 1180 MPa to about 1460 MPa, a yield strength of from about 1150 MPa to about 1415 MPa, an elongation of from about 8% to about 12%, a modulus of elasticity of about 110 GPa, a density of about 4.45 g/cm$^3$, and a hardness of about 43 on the Rockwell C scale (43 HRC). In particular embodiments, the Ti-8Al-2.5Mo-2Cr-1V-0.5Fe alloy can have a tensile strength of about 1320 MPa, a yield strength of about 1284 MPa, and an elongation of about 10%. The Ti-8Al-2.5Mo-2Cr-1V-0.5Fe alloy, particularly when used to cast golf club head bodies, promotes less deflection for the same thickness due to a higher ultimate tensile strength compared to other materials. In some implementations, providing less deflection with the same thickness benefits golfers with higher swing speeds because over time the face of the golf club head will maintain its original shape and have a lower tendency to deform over time.

Figure 4:
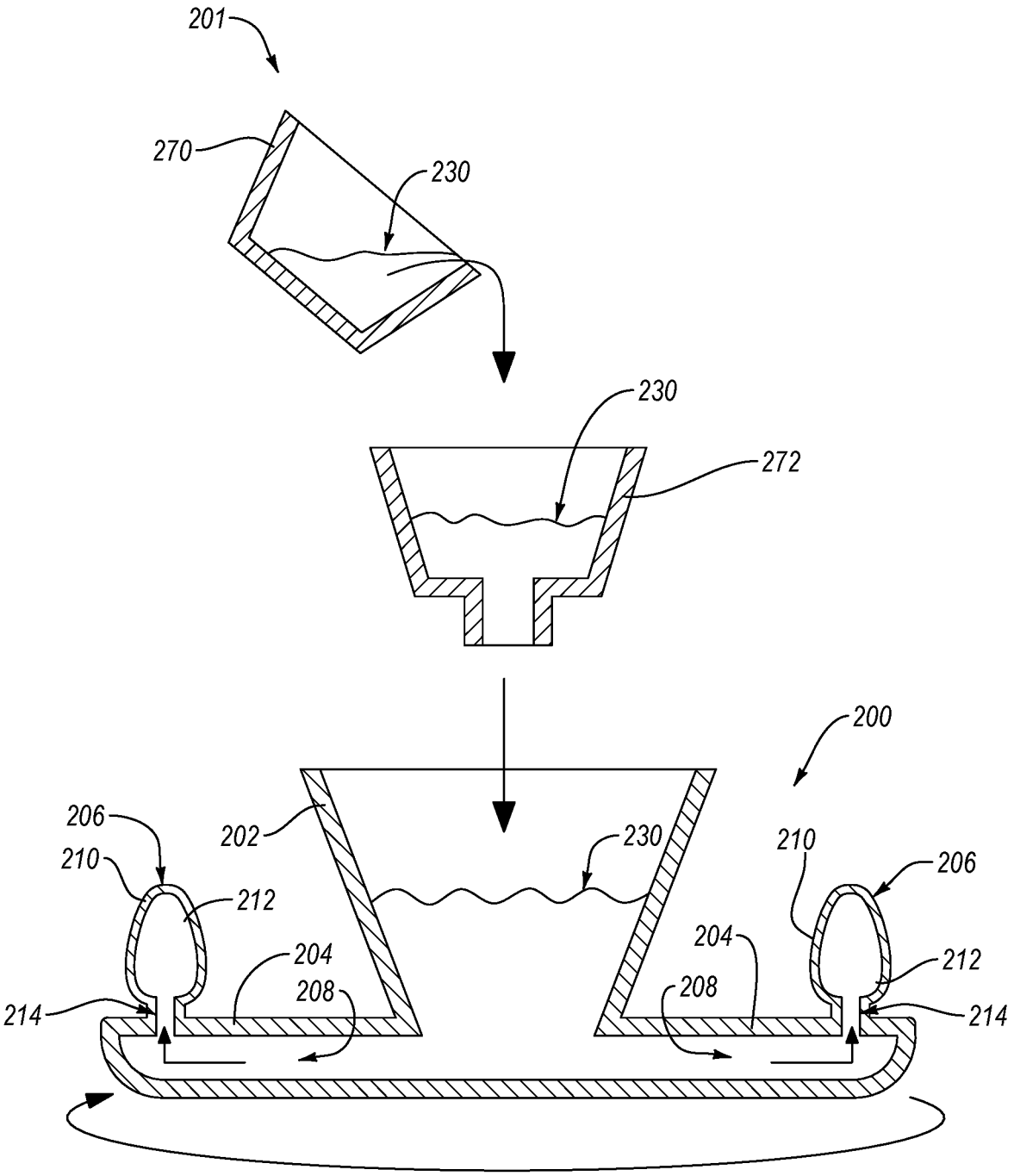
FIG. 4 is a cross-sectional side view of a casting system, including a casting cluster, according to one or more examples of the present disclosure.

The body 102 of the golf club head 100 is formed by a casting method 400 configured to make multiple bodies 102 out of a titanium-alloy at the same time. The multiple bodies 102 correspond with multiple golf club heads 100. In one example, the casting method 400 is configured to produce at least 42 bodies 110 at one time. In another example, the casting method 400 is configured to produce at least 52 bodies at one time. The casting method 400 is patterned generally after some features of so-called investment casting. Accordingly, each body 102 is formed from a corresponding cast of a plurality of casts of a casting cluster. Referring to FIG. 4, one example of a casting cluster 200, which forms part of a casting system 201, includes a plurality of molds 206 each in material receiving communication with a corresponding one of a plurality of runners 204. Each of the molds 206 includes a shell 210 that defines a mold cavity 212.

Figure 5:
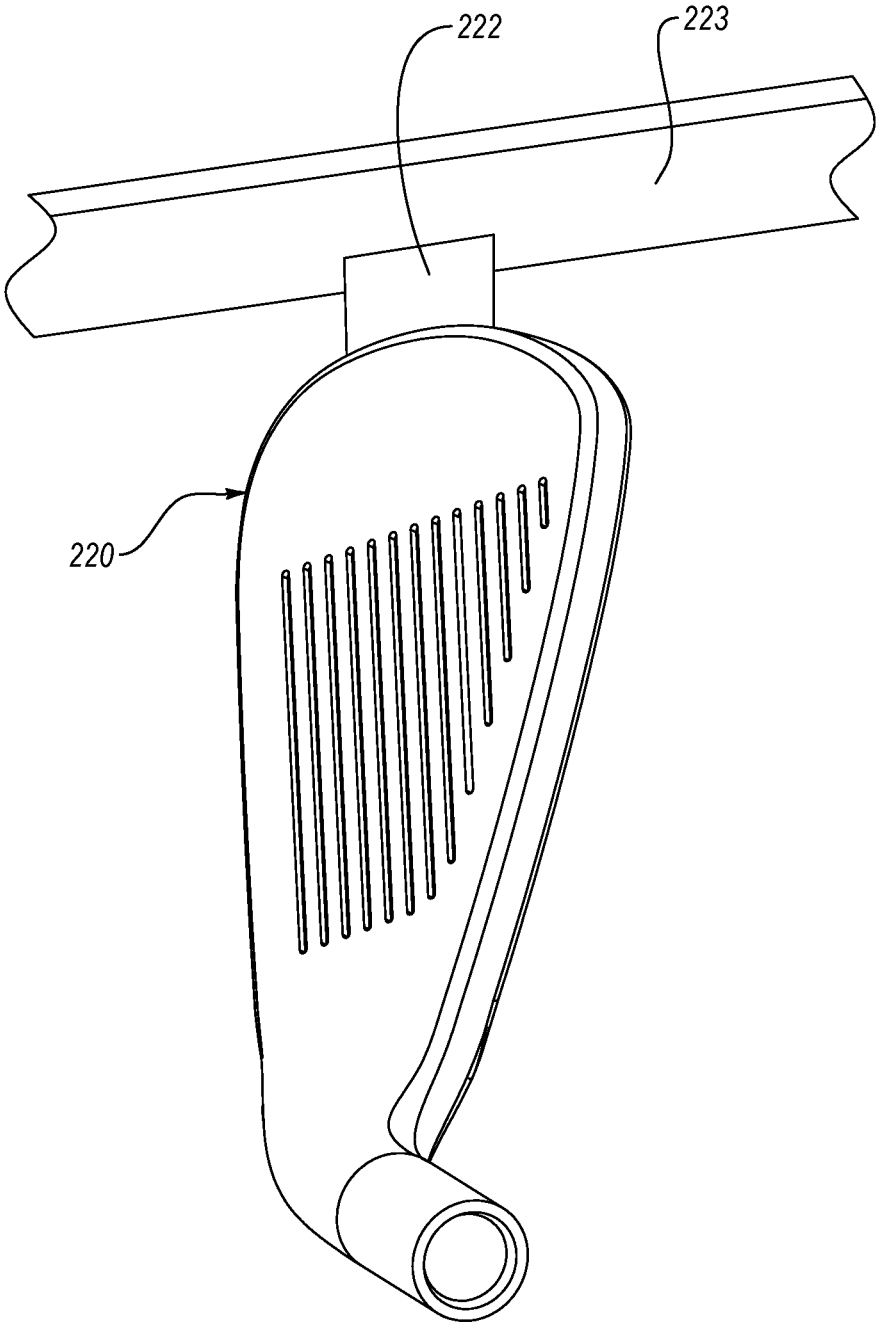
FIG. 5 is a top plan view of an initial pattern of casting wax, according to one or more examples of the present disclosure.

The casting method 400 includes forming the casting cluster 200 at 402. The sub-process for forming each of the molds 206 of the casting cluster 200 will now be described. Injection molding is used to form sacrificial "initial" patterns (made of casting "wax") of the desired castings. One example of an initial pattern 220 is shown in FIG. 5. The initial pattern 220, made of wax, replicates the desired design of the body 102, to be made of titanium or a titanium-alloy, to be cast using the casting method 400. A suitable injection die can be made of aluminum or other suitable alloy or other material by a computer-controlled machining process using a casting master. CNC (computer numerical control) machining desirably is used to form the intricacies of the mold cavity 212 in the die. The dimensions of the die are established so as to compensate for linear and volumetric shrinkage of the casting wax encountered during casting of the initial pattern 220 and also to compensate for any similar shrinkage phenomena expected to be encountered during actual metal casting performed later using the molds 206.

A group of initial patterns 220 of casting wax is assembled together and attached to a central wax sprue to form a wax "cluster" of initial patterns. Each initial pattern 220 in the wax cluster will be used to form a respective one of the molds 206, which are formed later around the initial patterns 220. The central wax sprue defines the locations and configurations of runners 208 and main gates 214 of the casting cluster 200, which are used for routing molten metal to the molds 206. For example, the central wax sprue includes initial runners 223 and initial main gates 222. Each initial main gate 222 couples together an initial pattern 220 and an initial runner 223.

The shells 210 of the molds 206 are constructed by immersing the wax cluster into a liquid ceramic slurry, followed by immersion into a bed of refractory particles. This immersion sequence is repeated as required to build up a sufficient wall thickness of ceramic material around the wax cluster, including the initial patterns, thereby forming the shells 210, which can be described as investment-casting shells. An exemplary immersion sequence includes six dips of the wax cluster in liquid ceramic slurry and five dips in the bed of refractory particles, yielding an investment-casting shell comprising alternating layers of ceramic and refractory material. In one example, the first two layers of refractory material comprise fine (e.g., 300 mesh) zirconium oxide particles, and the third to fifth layers of refractory material can comprise coarser (e.g., 200 mesh to 35 mesh) aluminum oxide particles. Each layer is dried under a controlled temperature (e.g., 25±5° C.) and relative humidity (e.g., 50±5%) before applying the subsequent layer.

The investment-casting shell is placed in a sealed steam autoclave in which the pressure is rapidly increased, such as to 7-10 kg/cm$^2$. Under such conditions, the wax of the initial patterns 220 in the shells 210 is melted out using injected steam thereby forming the mold cavity 212. The mold 206 is then baked in an oven in which the temperature is ramped up to, for example, 1,000° C. to 1,300° C. to remove residual wax and to increase the strength of the shell 210. The mold 206 is now ready for use in investment casting.

The runners 204, including the channels 208 and the main gates 214, of the casting cluster 200 are formed using the same process as that of the molds 206. More specifically, the investment-casting shell is also formed around the initial runners 223 and the initial main gates 222 of the wax cluster. After the wax is melted out, the remaining shell defines the runners 204 and the main gates 214.

An important aspect of configuring the casting cluster 200 is determining the locations at which to place the main gates 214. A mold cavity of a mold for an individual club head usually has one main gate, through which molten metal flows into the mold cavity. Additional auxiliary ("assistant") gates can be connected to the main gate by flow channels. During investment casting using such a mold, the molten metal flows into each of the mold cavities through the respective main gates, through the flow channels, and through the auxiliary gates. Referring to FIG. 5, this manner of flow requires that the die for forming the initial pattern 220 of a club head also define a runner channel pattern of initial runner channels 223, a main gate pattern of initial main gates 222, and any initial assistant gate patterns. After making the wax initial pattern 220 of the club head, the runner channel pattern, the main gate pattern, and any assistant gate patterns, they are removed from the die.

Multiple initial patterns 220, and corresponding main gate patterns, and assistant gate patterns, for respective club heads are then assembled into the casting cluster 200, which includes attaching the individual main gates to "ligaments." The ligaments include the sprue and runners of the casting cluster 200. As shown in FIG. 4, a receptor 202, usually made of graphite or the like, is placed at the center of the casting cluster 200, where it later will be used to receive the molten metal and direct the metal to the runners 204. The receptor 202 desirably has a funnel-like configuration to aid entry-flow of molten metal. Additional braces (made of, e.g., graphite) may be added to reinforce the casting cluster 200.

In some examples, the overall wax cluster is sufficiently large (especially if the furnace chamber that will be used for forming the shell is large) to allow pieces of wax to be "glued" to individual branches of the wax cluster first, followed by ceramic coating of the individual branches separately before the branches are assembled together into the casting cluster 200. Then, after assembling together the branches, the casting cluster 200 is transferred to a casting chamber (not shown) to cast the bodies 102.

Referring back to FIG. 4, after the casting cluster 200 is formed and the casting cluster 200 is rotating (as described below), the casting method 400 further includes, at 406, pouring molten metal 230 from a crucible 270 into the receptor 202 of the casting cluster 200 using a pouring cup 272. The pouring cup 272 helps to direct the molten metal 230 into the receptor 202. From the receptor 202, the molten metal 230 is urged, at 408 of the casting method 400, into the runner channels 208 or branches. From the runner channel 208, the molten metal 230 is urged into the mold cavities 212 of the molds 206 via the main gates 214 and any assistant gates.

At 404, the casting method 400 also includes rotating the casting cluster 200 in a centrifugal manner, as indicated by a rotational directional arrow, to harness and exploit the force generated by the $\omega^2 r$ acceleration of the casting cluster 200 undergoing such motion, where $\omega$ is the angular velocity of the casting cluster 200 and r is the radius of the angular motion. According to one example, angular rotation of the casting cluster 200 is performed using a turntable situated inside the casting chamber at a subatmospheric pressure. The force generated by the $\omega^2 r$ acceleration of the casting cluster 200 urges flow of the molten metal 230 into the mold cavities 212 without leaving voids. The casting cluster 200 (including its constituent molds 206 and runners 204) is generally assembled outside the casting chamber and heated to a pre-set temperature before being placed as an integral unit on the turntable in the casting chamber. After mounting the shell to the turntable, the casting chamber is sealed and evacuated to a pre-set subatmospheric-pressure (e.g., vacuum) level. As the chamber is being evacuated, the molten metal 230 is prepared and the turntable commences rotating. When the molten metal 230 is ready for pouring into the casting cluster 200, the casting chamber is at the proper vacuum level, the casting cluster 200 is at a suitable temperature, and the turntable is spinning at the desired angular velocity. Thus, the molten metal 230 is poured into the receptor 202 of the casting cluster 200 and flows throughout the casting cluster 200 to fill the mold cavities 212 of the molds 206.

Configuring the features of the casting cluster 200, including the main gates 214, the runners 204, and the molds 206 involves consideration of multiple factors. These factors include (but are not necessarily limited to): (a) the dimensional limitations of the casting chamber of the metal-casting furnace, (b) handling requirements, particularly during the slurry-dipping steps that form the casting cluster 200, (c) achieving an optimal flow pattern of the molten metal 230 in the casting cluster 200, (d) providing the runners 204, the main gates 214, and the molds 206 of the casting cluster 200 with at least minimum strength required for them to withstand rotational motion during metal casting, (e) achieving a balance of minimum resistance to flow of the molten metal 230 into the mold cavities 212 (by providing the runners 204 and the main gates 214 with sufficiently large cross-sections) versus achieving minimum waste of metal (e.g., by providing the runners 204 with small cross-sections), and (f) achieving a mechanical balance of the casting cluster 200 about a central axis of the casting cluster 200. Factor (e) is important because, after casting, any metal remaining in the runners 204 does not form product, but rather is contaminated or lost (even though a portion of contaminated material can be recycled). These configurational factors are considered along with metal-casting parameters, such as a cluster-preheat temperature and time, the vacuum level in the casting chamber, and the angular velocity of the turntable to produce actual casting results. As the number of bodies of golf club heads cast together in a single cluster increases, careful selection and balance of these factors and parameters are important for producing adequate casting results.

Details of investment casting using various casting clusters, for making titanium-based golf club heads, tend to be proprietary. But, experiments with various casting clusters disclosed herein revealed some consistencies and some general trends. For example, an iron-type golf club head 100, such as one disclosed herein, was fabricated using a casting cluster disclosed herein, such as casting cluster 200A (having respective metal-casting furnaces ranging from 10 kg to 80 kg capacity). The casting cluster used to fabricate the iron-type golf club head 100 and corresponding casting processes produced the data tabulated in FIGS. 6A and 6B. The parameters listed in FIGS. 6A and 6B include the following:

"R max" is the maximum radius of the cluster

"R min" is the minimum radius of the cluster

"Wet perimeter" is the total perimeter of the runner

R (flow radius)" is the cross-sectional area/wet perimeter of the runner

"Sharp turn" is a 90-degree or greater turn in the runner system

"Process loss ratio" is the ratio of process loss to pouring material

"Velocity max" is the velocity at the maximum radius (=ω·R max)

"Velocity min" is the velocity at the minimum radius (=ω·R min)

"Acceleration max" is the acceleration at the maximum radius (=(=ω2·R max)

"Acceleration min" is the acceleration at the minimum radius (=ω2·R min)

"Force max" is the force at the maximum radius (=material usage (with process loss)·Acceleration max). Note that this is an approximation of the magnitude of force being applied to the molten metal at a gate. Due to each particular cluster design, the true force is almost always lower than the calculated value, with more complex clusters exhibiting greater reduction of the force.

"Force min" is the force at the minimum radius (=material usage (with process loss)·Acceleration min). Note that this is an approximation of the magnitude of force being applied to the molten metal at the gate. Due to each particular cluster design, the true force is almost always lower than the calculated value, with more complex clusters exhibiting greater reduction of the force.

"Pressure max" is the pressure of molten metal in the runner at maximum radius (=Force max/Runner cross-sectional area)

"Pressure min" is the pressure of molten metal in the runner at minimum radius (=Force min/Runner cross-sectional area)

"Kinetic energy max" is the kinetic energy of molten metal at the maximum radius (=½·material usage (w/process loss)·velocity max2)

"Density (ρ)" is the density of molten metal (titanium alloy) at the melting point of 1650° C. Note that most casting clusters would apply overheat by heating to above 1700° C.; however, the general trend is similar for purposes of this analysis.

"Viscosity (μ)" is the viscosity of molten titanium at 1650° C. Note that most casting clusters would apply overheat by heating to above 1700° C.; however, the general trend is similar for purposes of this analysis.

"Re number max" is the Reynolds number for pipe flow at maximum radius. The Reynolds number is defined as:

$$\mathrm{Re} = \frac{DV_{ave}\rho}{\mu}$$

where D is pipe diameter (i.e., 4·R (flow radius)), $V_{ave}$ is average velocity of pipe flow (assumed to be identical to Velocity max), ρ is density, and μ is viscosity. "Re number min" is defined consistently as Re number max, but at a minimum radius. Referring to FIG. 6A, the interference gating ratio is defined as runner cross-sectional area divided by the cross-sectional area of the main gate. The cluster achieved a near optimal interface gating ratio (100%).

FIGS. 6A and 6B indicate that at least a minimum force (and thus at least a minimum pressure) should be applied to the molten metal entering the molds of the cluster to achieve a good casting yield. The force applied to the molten metal is generated in part by the mass of actual molten metal entering the mold cavities in the cluster and by the centrifugal force produced by the rotating turntable of the casting furnace. A reduced minimum force is desirable because a lower force generally allows a reduction in the amount, per club head, of molten metal necessary for casting. However, other factors tend to indicate increasing this force, including:

thinner wall sections in the item being cast, more complex clusters (and thus more complex flow patterns of the molten metal), reduced mold-preheat temperatures (resulting in a greater loss of thermal energy from the molten metal as it flows into the mold), and substandard mold qualities such as rough mold-cavity walls and the like. The data in FIGS. 6A and 6B indicates that the minimum force required for casting a titanium-alloy iron-type golf club head is less than 125 Nt.

A lower threshold of the amount of molten metal necessary for pouring into the shell can be derived from the minimum-force requirement. Excluding unavoidable pouring losses, the metal usage was 228 g (0.228 kg) for each club head.

Figure 7:
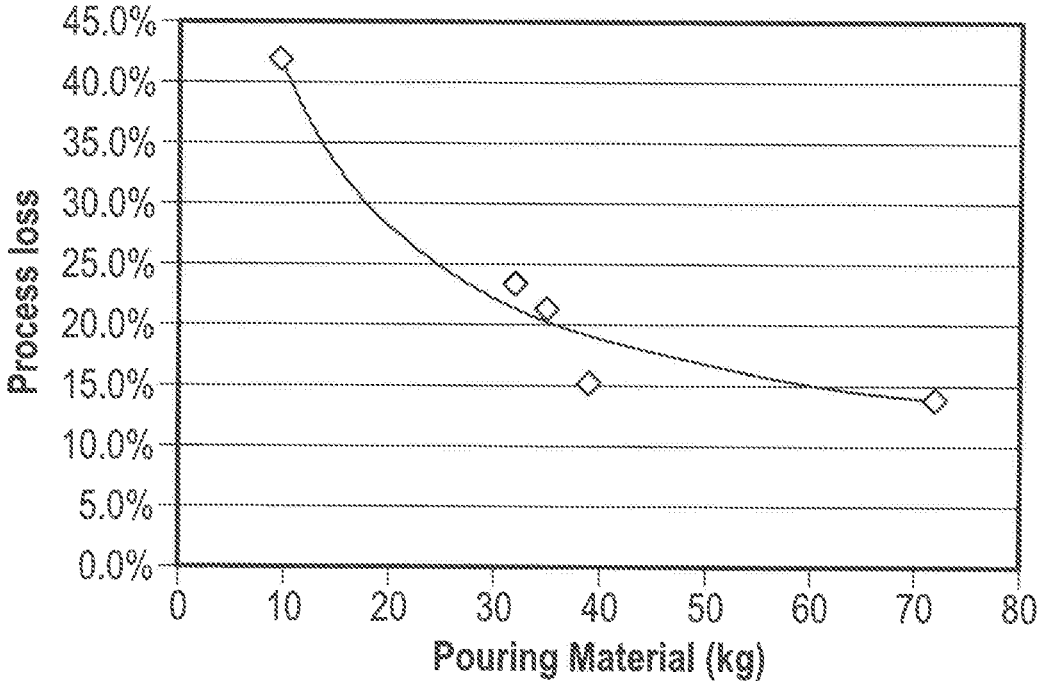
FIG. 7 is a plot comparing process loss versus mass of pouring material (molten metal), the latter being indicative of casting-furnace size for various casting clusters, according to one or more examples of the present disclosure.

Some process loss (splashing, cooled metal adhering to side walls of the crucible and coup supplying the liquid titanium alloy, revert cleaning loss, and the like) is unavoidable. Process loss imposes an upper limit to the efficiency that can be achieved by smaller casting furnaces. For example, the percentage of process loss increases rapidly with decreases in furnace size, as illustrated in FIG. 7.

On the other hand, smaller casting furnaces advantageously have simpler operation and maintenance requirements. Other advantages of smaller furnaces are: (a) they tend to process smaller and simpler clusters of mold cavities, (b) smaller clusters tend to have separate respective runners feeding each mold cavity, which provides better interface-gating ratios for entry of molten metal into the mold cavities, (c) the furnaces are more easily and more rapidly preheated prior to casting, (d) the furnaces offer a potentially higher achievable shell-preheat temperature, and (e) smaller clusters tend to have shorter runners, which have lower Reynolds numbers and thus pose reduced potentials for disruptive turbulent flow. While larger casting furnaces tend not to have these advantages, smaller casting furnaces tend to have more unavoidable process loss of molten metal per mold cavity than do larger furnaces. In view of the above, the most cost-effective casting systems (furnaces, clusters, yields, net material costs) appear to be medium-sized systems, so long as appropriate cluster and gate design considerations are incorporated into configurations of the clusters used in such furnaces.

At least the minimum threshold force applied to molten metal entering the molds of the clusters can be achieved by either changing the mass or increasing the velocity of the molten metal entering the shell, typically by decreasing one and increasing the other. There is a realistic limit to the degree to which the mass of "pour material" (molten metal) can be reduced. As the mass of pour material is reduced, correspondingly more acceleration is necessary to generate sufficient force to move the molten metal effectively into the investment-casting molds. But, increasing the acceleration increases the probability of creating turbulent flow (due to a high $V_{ave}$) of the molten metal entering the molds. Turbulent flow is undesirable because it disrupts the flow pattern of the molten metal. A disrupted flow pattern can require even greater force to "push" the metal though the main gate into the mold cavities.

Note that the Reynolds number for the cluster is $2.84\times10^5$. It is unclear what the critical Reynolds number would be for a corresponding type of boundary-layer problem involving molten titanium flowing in a pipe geometry (and eventually into a plate-like mold cavity, as in an actual mold cavity for a club-head), it is nonetheless desirable that the Reynolds number be as low as possible. The data in FIGS. 6A and 6B indicates that the optimal Reynolds number is approximately $2.2\times10^5$. For this cluster, this Reynolds number is equivalent to $V_{ave}$=10.47 m/s. Higher Reynolds numbers indicate a high potential of turbulent flow, which offsets the advantage of high flow velocity of the molten metal (produced by the high angular velocity of the turntable).

The Reynolds number can be easily modified by changing the shape and/or dimensions of the runner(s). For example, changing R (flow radius) will affect the Reynolds number directly. The smaller R (flow radius) will result in less minimum force (the two almost having a reciprocal relationship). Hence, an advantageous consideration is first to reduce the Reynolds number to maintain a steady flow field of the molten metal, and then satisfy the requirement of minimum force by adjusting the amount of pour material.

From this analysis, smaller clusters are not the only way to obtain high yield. But, smaller clusters are more likely to produce a higher yield due mainly to their relative simplicity. It would be more difficult to fine-tune a larger cluster to reach the same level of performance that is achieved by a smaller cluster.

An additional factor affecting the results of the casting process is preheating the investment-casting cluster before introducing the molten metal to it. Another factor is the complexity of the cluster(s). Evaluating a complex cluster is very difficult, and the high Reynolds numbers usually exhibited by such clusters are not the only variable to be controlled to reduce disruptive turbulent flow of molten metal in such clusters. For example, the number of "sharp" turns (90-degree turns or greater) in runners and mold cavities of the cluster is also a factor. It is possible that casters with more sharp turns need to rotate its shell at a higher angular velocity just to overcome the flow resistance posed by these sharp turns. But, this would not alleviate, disrupted flow patterns posed by the sharp turns. Hence, simpler cluster(s) (with fewer sharp turns to allow more "natural" flow routes of molten metal) are desired.

Another factor is matching the runner and gates of a cluster so that the interface gating ratio is as close to 1.0 (i.e., 100%) as possible. In the cluster with the characteristics identified in FIGS. 6A and 6B, the interface gating ratio was approximately 103%. The overall cross-sectional areas of runners and main gates should be kept as nearly equal (and constant) to each other as possible to achieve constant flow velocity of liquid metal throughout the cluster at any moment during pouring. For thin-walled titanium castings, this principle applies especially to the interfaces between the runner and the main gates, where the interface gating ratio should be no less than unity (1.0).

Yet another factor is the cross-sectional shape of the runner. Triangular-section runners seem to produce lower Reynolds numbers than rounded or rectangular runners. Although using triangular-section runners can cause problems with the interface gating ratio (as metal flows from such a runner into a rectilinear-section or round-section main gate), the significant reduction in Reynolds numbers achieved using triangular-section runners is worth pursuing in some examples.

Figure 8:
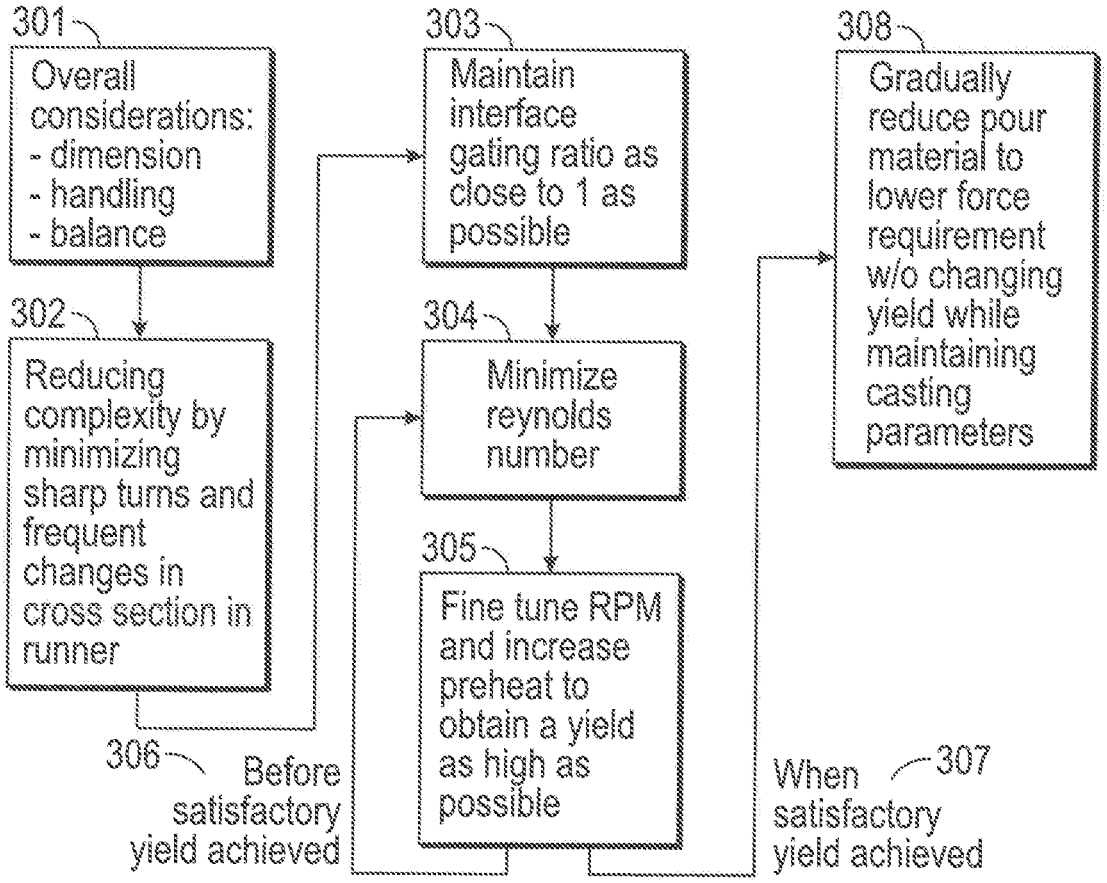
FIG. 8 is a flow chart of a method of configuring a casting cluster, according to one or more examples of the present disclosure.

A flow-chart for a method 300 of configuring a casting cluster is shown in FIG. 8. In a first step of the method 300, overall considerations of the intended cluster are made such as dimensions, handling, and balance (step 301). Next, the complexity of the cluster is reduced by minimizing sharp turns and any unnecessary (certainly any frequent) changes in runner cross-section (step 302). The interface gating ratio is maintained as close as possible to unity (step 303). Also, the Reynolds number is minimized as much as practicable (step 304). The angular velocity (RPM) of the turntable is fine-tuned and the shell pre-heat temperature is increased to produce the highest possible product yield (step 305). Iteration of steps 304, 305 is usually required to achieve a satisfactory yield (step 306). After a satisfactory yield is achieved (307), the mass of pour material (molten metal) is gradually reduced to reduce the force required to urge flow of molten metal throughout the cluster, but without decreasing product yield and while maintaining other casting parameters (step 308).

To reduce material and labor costs, in some examples, it is desirable to configure the casting cluster to manufacture more heads. However, due to size constraints associated with the furnace and other manufacturing facilities, it is also desirable to limit the overall outer peripheral size of the casting cluster. To promote the reduction of both cost and size, disclosed herein are several examples of a casting cluster that accommodates concurrent casting of at least forty golf club heads of the iron construction type. The casting cluster of each of the examples includes a receptor 202, runners 204, and main gates 214. At least two of at least forty molds 206 are coupled to a respective one of the runners 204. Moreover, each mold of the at least forty molds 206 receives molten metal 230 from a runner channel 208 of a corresponding runner 204 via a corresponding one of the main gates 214. By placing more than one mold 206 at specific locations on each runner 204, more golf club heads can be cast at a lower cost per head and at a higher rate, while achieving an acceptable yield rate (e.g., at least 80%).

In operation, molten metal 230 flows directly into the runner channel 208 of a runner 204 at a proximal end 240 of the runner 204 and flows in a radially outwardly direction from the proximal end 240 to a distal end 242. The molten metal 230 flows into the molds 206 of each runner 204 via the corresponding main gates 214. In some examples, the runner channels 208 can include one or more filters (made, e.g., of ceramic) for enhancing smooth laminar flow of molten metal into and through the molds 206 and for preventing entry of any dross into the molds 206. The casting cluster can be rotated as the molten metal 230 flows into the casting cluster to increase the force urging the molten metal 230 through the runners 204 and into the molds 206. Because of the additional molds of the casting clusters disclosed herein, the casting clusters are rotated at a rotational speed of at least 450 RPM, in some examples, and at a rotational speed of at least 500 RPM.

Figure 9:
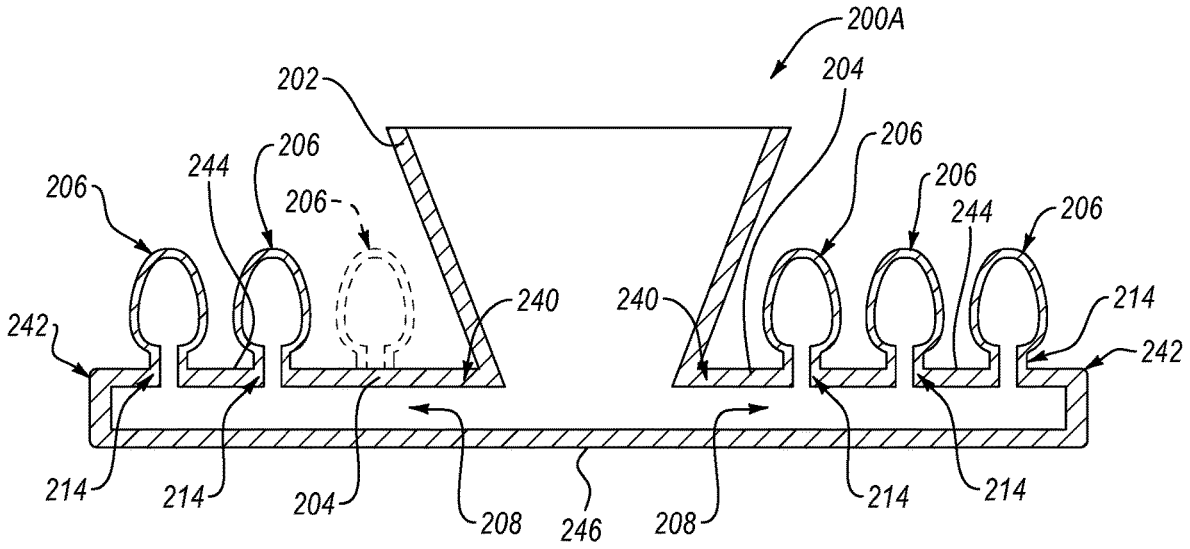
FIG. 9 is a cross-sectional side view of a casting cluster, according to one or more examples of the present disclosure.
Figure 10:
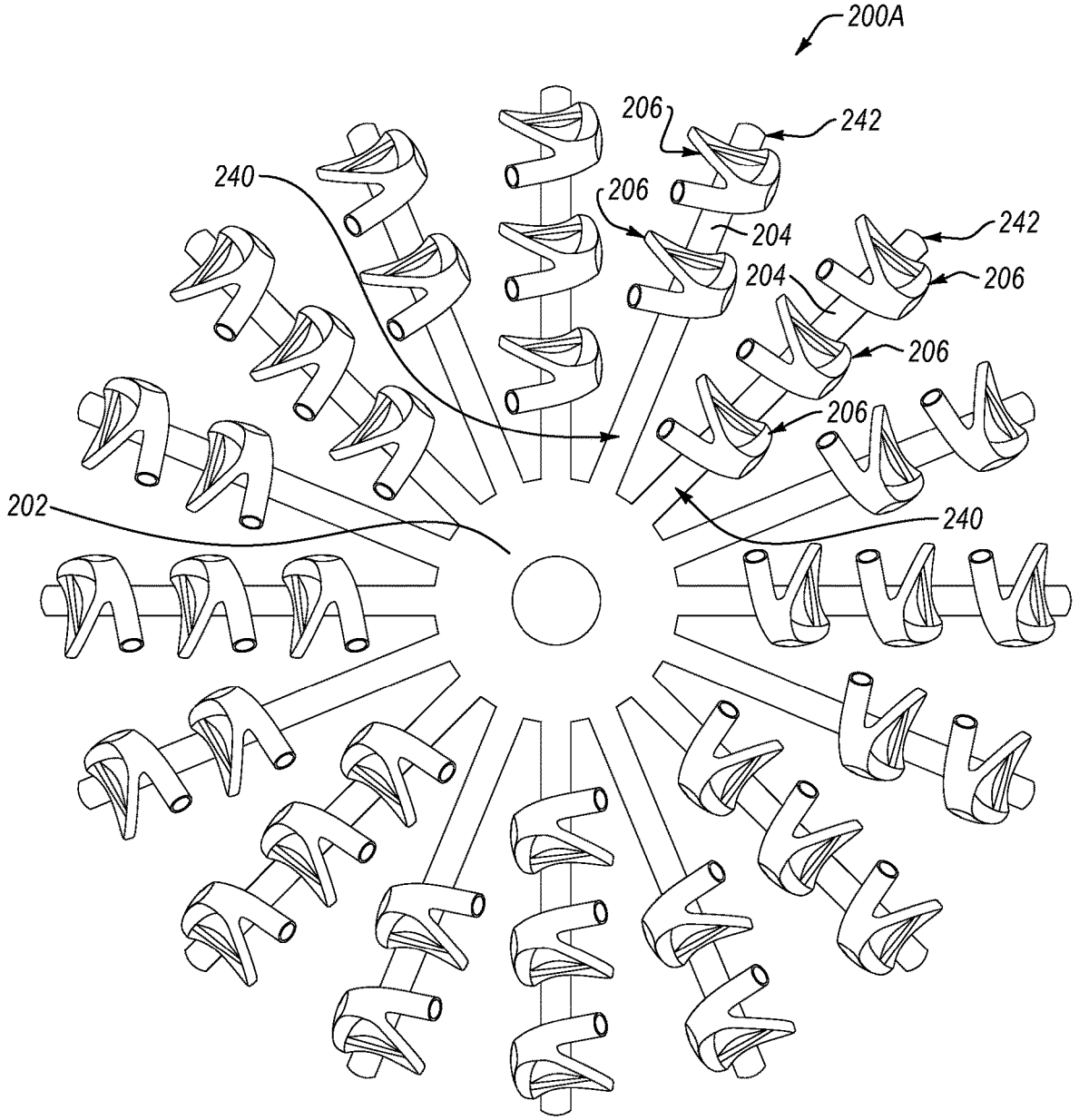
FIG. 10 is a plan view of a casting cluster, with forty mold cavities, according to one or more examples of the present disclosure.

Referring to FIGS. 9 and 10, and according to one example, a casting cluster 200A includes at least two molds 206 located at a top surface 244 of each runner 204, no molds located at a bottom surface 246 of each runner 204, and no molds at the distal ends 242 of each runner 204. The casting cluster 200A includes sixteen runners 204 and forty molds 206. Accordingly, each of eight runners 204 of the sixteen runners 204 includes three molds 206 at the top surface 244 and each of eight runners 204 includes just two molds 206 at the top surface 244. Optionally, as indicated in dashed line in FIG. 9, in some examples, each of the sixteen runners 204 includes three molds, such that the casting cluster 200A includes forty-eight molds 206. The distal end 242 of each runner 204 is opposite a proximal end 240 of the runner 204. The proximal end 240 is adjacent to (e.g., adjoins) the receptor 202. The molds 206 coupled to the top surface 244 of the runners 204 protrude from the top surface 244 upwardly away from the corresponding bottom surface 244 of the runners 204.

Figure 11:
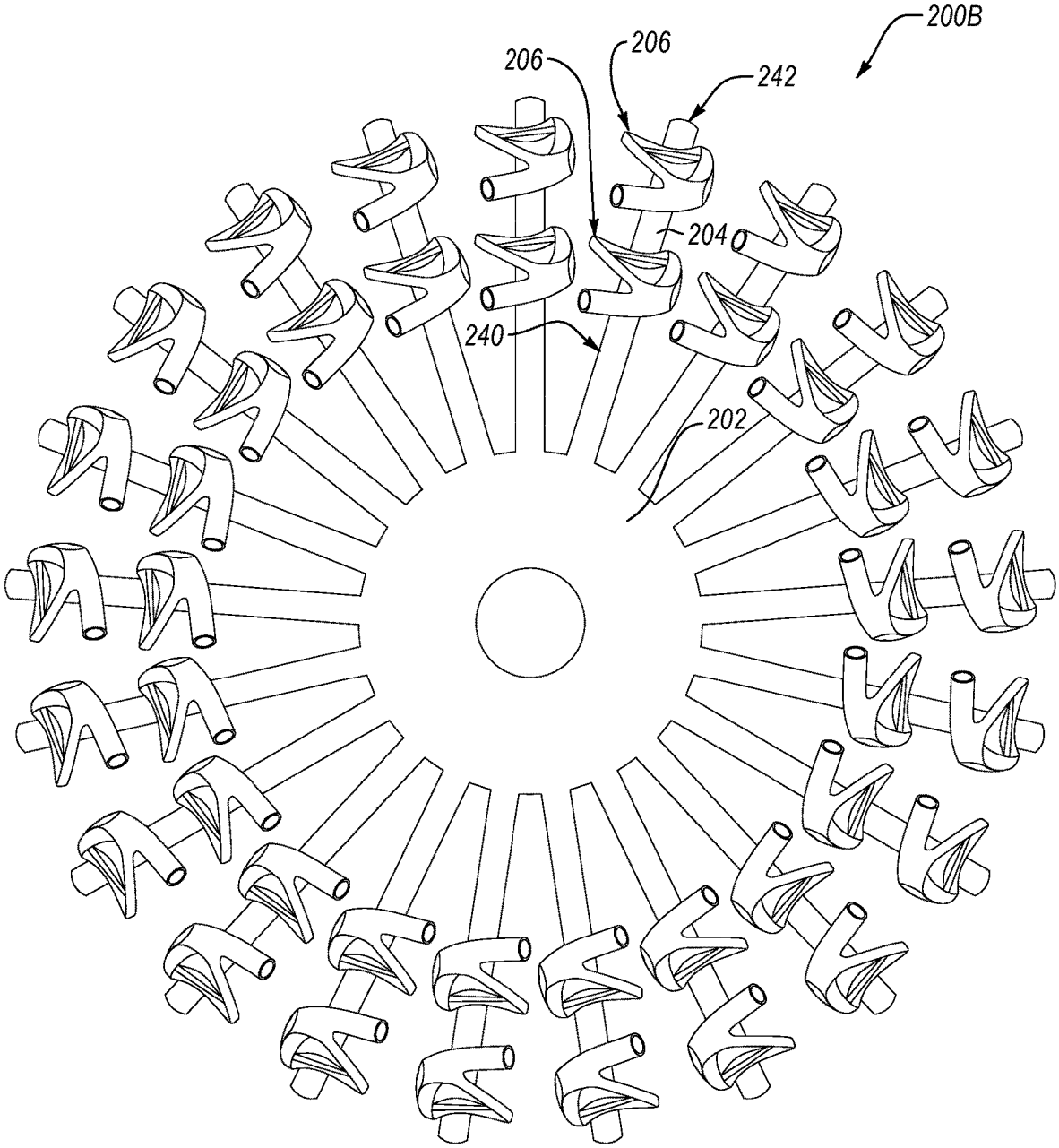
FIG. 11 is a plan view of a casting cluster, with forty-two mold cavities, according to one or more examples of the present disclosure.

Referring to FIG. 11, and according to one example, a casting cluster 200B includes twenty-one runners 204 with two molds 206 located on each runner 204. Accordingly, the casting cluster 200B includes forty-two molds 206. In certain implementations, the molds 206 of the casting cluster 200B are all located on the upper surface 244 of the corresponding runner 204 to which the molds 206 are coupled, between the distal end 242 and the proximal end 240 of the runner 204. However, in other examples, the molds 206 of casting cluster 200B can be arranged according to any of the various mold configurations disclosed herein.

Figure 12:
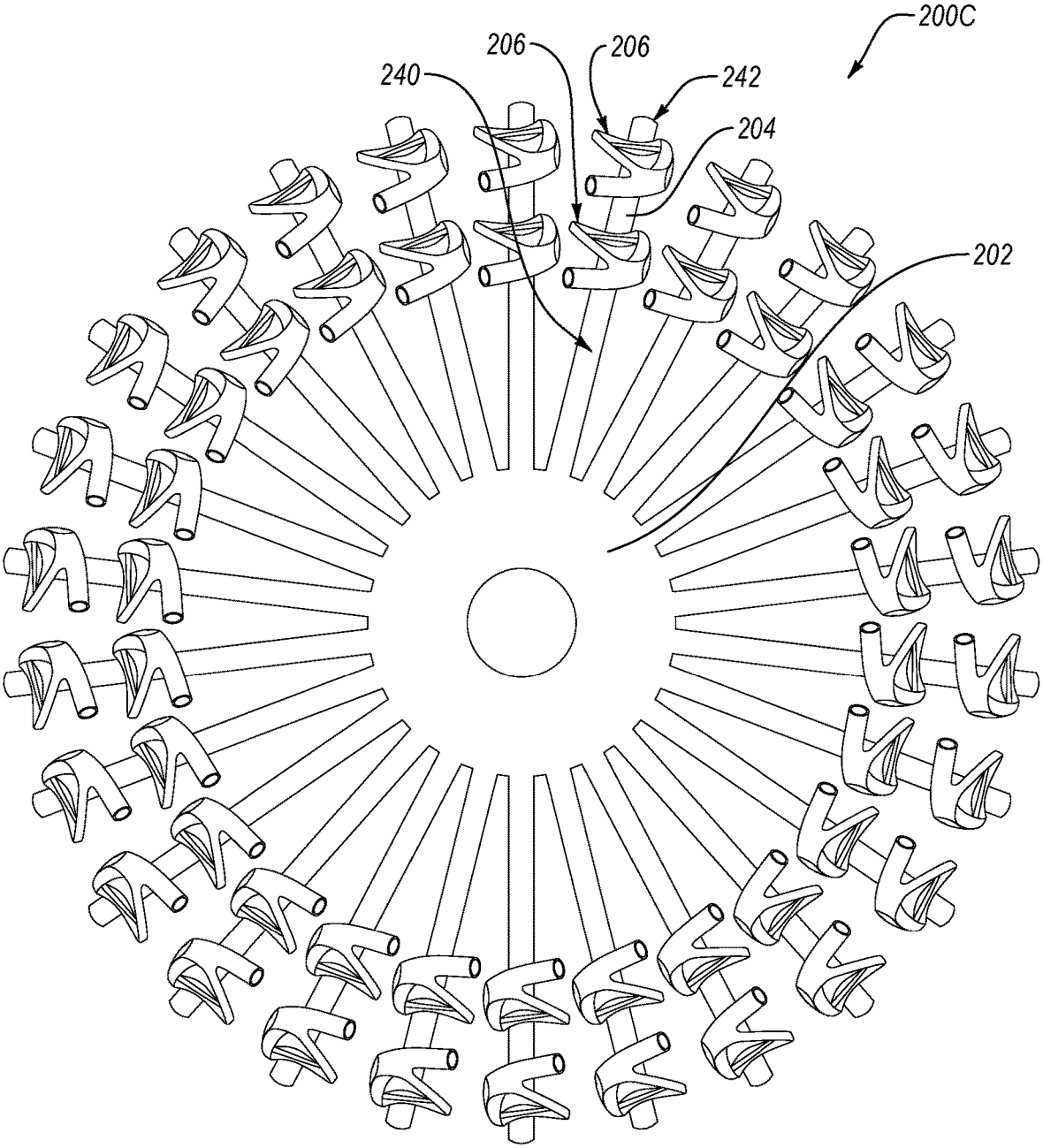
FIG. 12 is a plan view of a casting cluster, with fifty-two mold cavities, according to one or more examples of the present disclosure.

Referring to FIG. 12, and according to one example, a casting cluster 200C is similar to the casting cluster 200B, but includes twenty-six runners 204 with two molds 206 located on each runner 204. Accordingly, the casting cluster 200C includes fifty-two molds 206. In certain implementations, the molds 206 of the casting cluster 200C are all located on the upper surface 244 of the corresponding runner 204 to which the molds 206 are coupled, between the distal end 242 and the proximal end 240 of the runner 204. However, in other examples, the molds 206 of casting cluster 200C can be arranged according to any of the various mold configurations disclosed herein.

Figure 13:
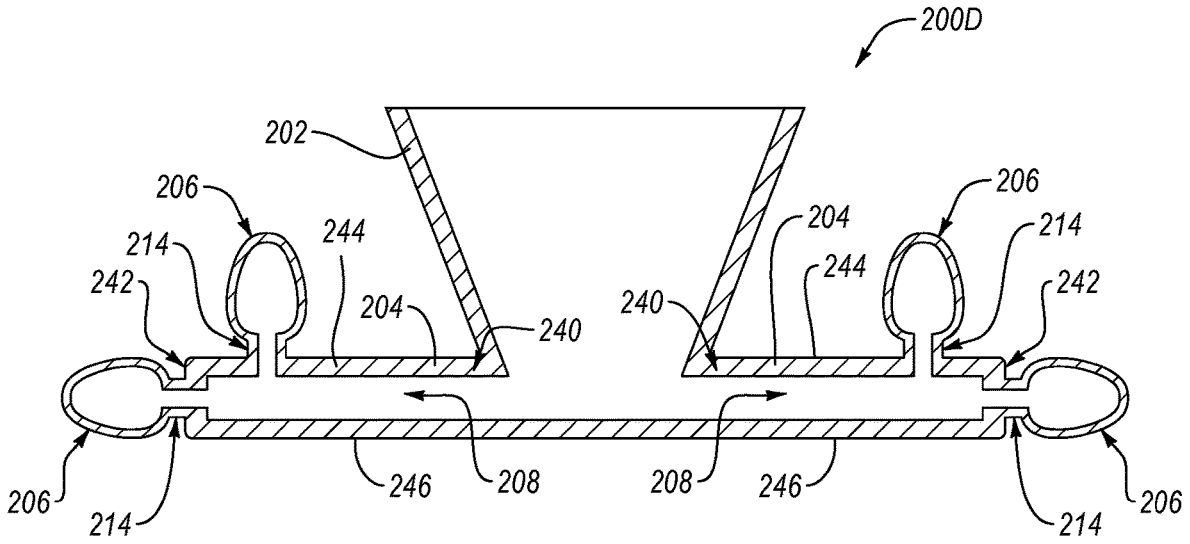
FIG. 13 is a cross-sectional side view of a casting cluster, according to one or more examples of the present disclosure.

Referring to FIG. 13, according to one example, a casting cluster 200D includes one mold 206 located at a distal end 242 of each runner 204 and one mold 206 located at a top surface 244 of each runner 204. The casting cluster 200D includes twenty-one runners 204. Accordingly, the casting cluster 200D includes forty-two molds 206. The mold 206, located at the top surface 244 of each runner 204, is positioned between the proximal end 240 and the distal end 242. In the illustrated embodiment, each mold 206, located at the top surface 244 of a corresponding runner 204, is positioned closer to the distal end 242 of the runner 204 than the proximal end 240 of the runner. However, in other examples, each mold 206, located at the top surface 244 of a corresponding runner 204, can be positioned closer to the proximal end 240 of the runner 204 than the distal end 242 of the runner 204. The molds 206 coupled to the top surface 244 of the runners 204 protrude from the top surface 244 upwardly away from the bottom surfaces 246 of the runners 204. Because the main gates 214 of the molds 206 at the distal ends 242 of the runners 204 are parallel to or in-line with the corresponding runner channels 208, such that the flow of molten metal 230 through the runner channels 208 is the same direction as through the corresponding main gates 214, these molds 206 are considered "straight-feed" molds. In contrast, because the main gates 214 of the molds 206 between the proximal ends 240 and the distal ends 242 of the runners 204 are perpendicular to the corresponding runner channels 208, such that the flow of molten metal 230 through the runner channels 208 is perpendicular to the flow through the corresponding main gates 214, these molds 206 are considered "side feed" molds.

Although not shown, in some examples, a casting cluster is similar to the casting cluster 200D but includes one mold 206 located at a distal end 242 of each runner 204 and one mold 206 located at a bottom surface 246 of each runner 204. This casting cluster includes twenty-one runners 204. Accordingly, this casting cluster includes forty-two molds 206. The molds 206 coupled to the bottom surface 246 of the runners 204 protrude from the bottom surface 246 downwardly away from the top surfaces 244 of the runners 204. These molds 206, being downwardly protruding, benefit from the additional downwardly directed gravitation force to help urge the molten metal 230 into the molds 206.

Figure 14:
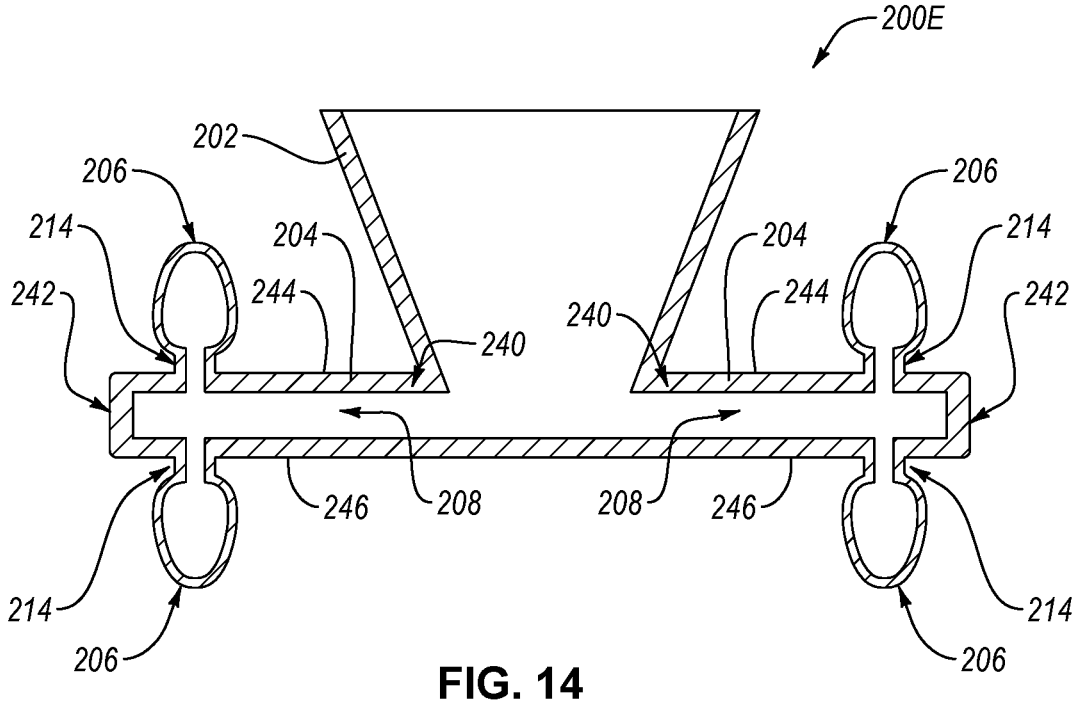
FIG. 14 is a cross-sectional side view of a casting cluster, according to one or more examples of the present disclosure.

Referring to FIG. 14, another example of a casting cluster 200E is shown. The casting cluster 200E is similar to the casting cluster 200A and the casting cluster 200D. For example, the casting cluster 200E includes one mold 206 at the top surface 244 of each runner 204 and one mold 206 at the bottom surface 246 of each runner 204. However, unlike the casting cluster 200D, the casting cluster 200E does not include a mold 206 at the distal end 242 of each runner 204. In the illustrated implementation, the main gates 214 of the molds 206 of each runner 204 are vertically aligned. In other words, the molds 206, located at the top surface 244 and the bottom surface 246 of each runner 204, are positioned at the same location between the proximal end 240 and the distal end 242 of the runner 204. But, in other implementations, the main gates 214 of the molds 206 of each runner 204 are not vertically aligned such that the molds 206, located at the top surface 244 and the bottom surface 246 of each runner 204, are positioned at different locations between the proximal end 240 and the distal end 242 of the runner 204. The molds 206 of each runner 204 of the casting cluster 200E can be located closer to the distal end 242 of the runner 204 than the proximal end 240 of the runner 204. However, in other examples, the molds 206 of each runner 204 of the casting cluster 200E can be positioned closer to the proximal end 240 of the runner 204 than the distal end 242 of the runner 204.

Figure 15:
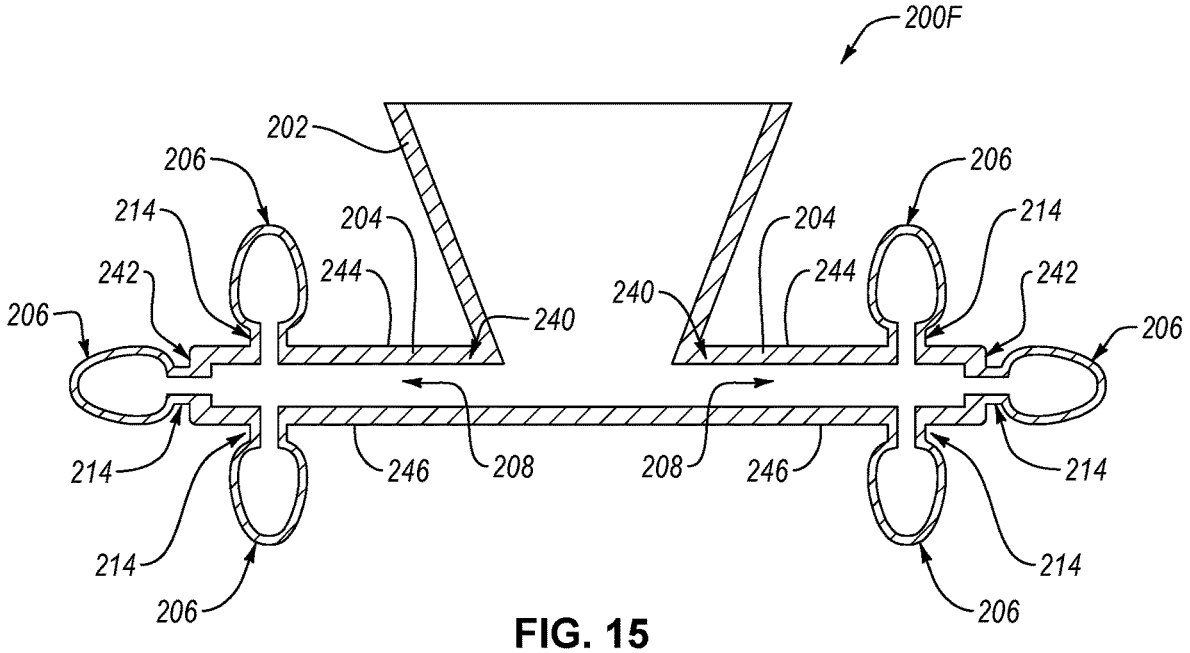
FIG. 15 is a cross-sectional side view of a casting cluster, according to one or more examples of the present disclosure.

Referring to FIG. 15, another example of a casting cluster 200F is shown. The casting cluster 200F is similar to the casting cluster 200E. For example, the casting cluster 200F includes one mold 206 at the top surface 244 of each runner 204 and one mold 206 at the bottom surface 246 of each runner 204. However, unlike the casting cluster 200E, the casting cluster 200F also includes a mold 206 at the distal end 242 of each runner 204. Therefore, each runner 204 of the casting cluster 200F includes three molds 206. In some implementations, the casting cluster 200F includes sixteen runners 204 and forty-eight molds 206, twenty-one runners 204 and sixty-three molds 206, or twenty-six runners 204 and seventy-eight molds 206. The main gates 214 of the molds 206 at the top surface 244 and the bottom surface 246 of each runner 204 can be vertically aligned or vertically misaligned. Moreover, the molds 206 of each runner 204 of the casting cluster 200F, between the proximal end 240 and the distal end 242, can be located closer to or further away from the distal end 242 of the runner 204 than the proximal end 240 of the runner 204.

Figure 16:
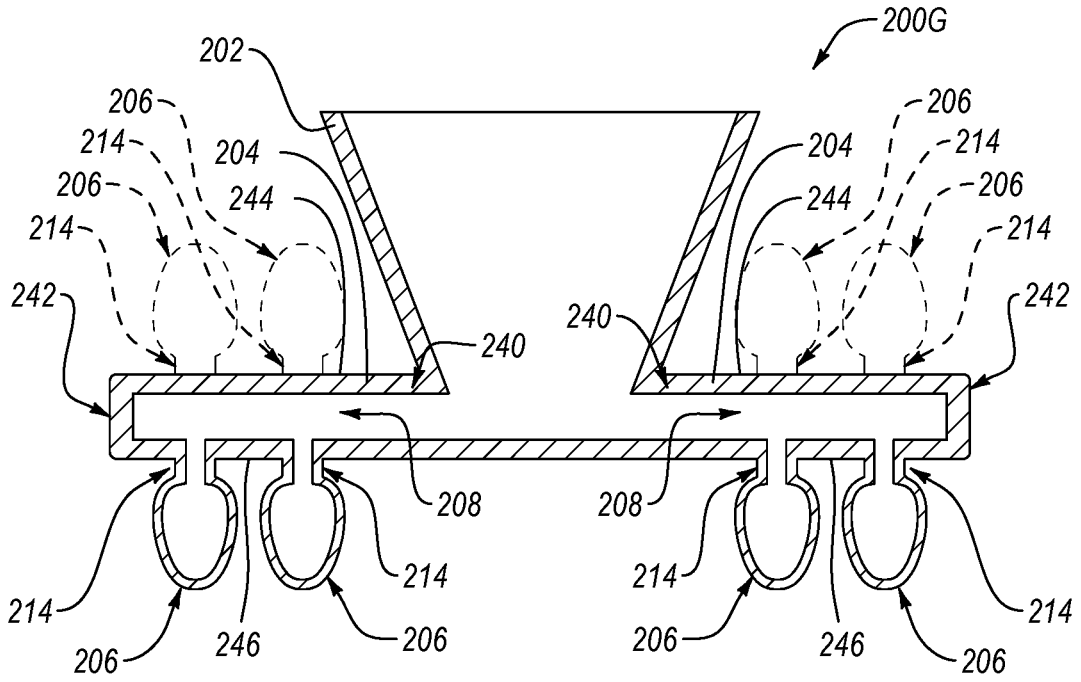
FIG. 16 is a cross-sectional side view of a casting cluster, according to one or more examples of the present disclosure.

Referring to FIG. 16, another example of a casting cluster 200G is shown. The casting cluster 200G is similar to the casting cluster 200E. For example, the casting cluster 200G includes a mold 206 at the bottom surface 246 of each runner 204. However, unlike the casting cluster 200E, the casting cluster 200G includes an additional mold 206 at the bottom surface 246 of each runner 204 and no mold 206 at the top surface 144 of each runner 204. Accordingly, each runner 204 includes two molds 206 at and protruding from the bottom surface 246 of the runner 204. In one implementation, the casting cluster 200G includes twenty-one runners 204 and forty-two molds 206. Both molds 206 of each runner 204 of the casting cluster 200G, between the proximal end 240 and the distal end 242, can be located closer to or further away from the distal end 242 of the runner 204 than the proximal end 240 of the runner 204. Alternatively, one of the molds 206 of each runner 204 can be located closer to the proximal end 240 of the runner 204 and the other of the molds 206 of each runner 204 can be located closer to the distal end 242 of the runner 204. As shown in dashed line, in another example, in addition to each runner 204 having two molds 206 at the bottom surface 246 of each runner 204, the casting cluster 200G can have one or two molds 206 at the top surface 244 of each runner 204. In yet another example, the casting cluster 200G can include another mold 206, at the distal end 242 of each runner 204, in addition to the two molds 206 at the bottom surface 246 or the top surface 244 of each runner 204.

Figure 17:
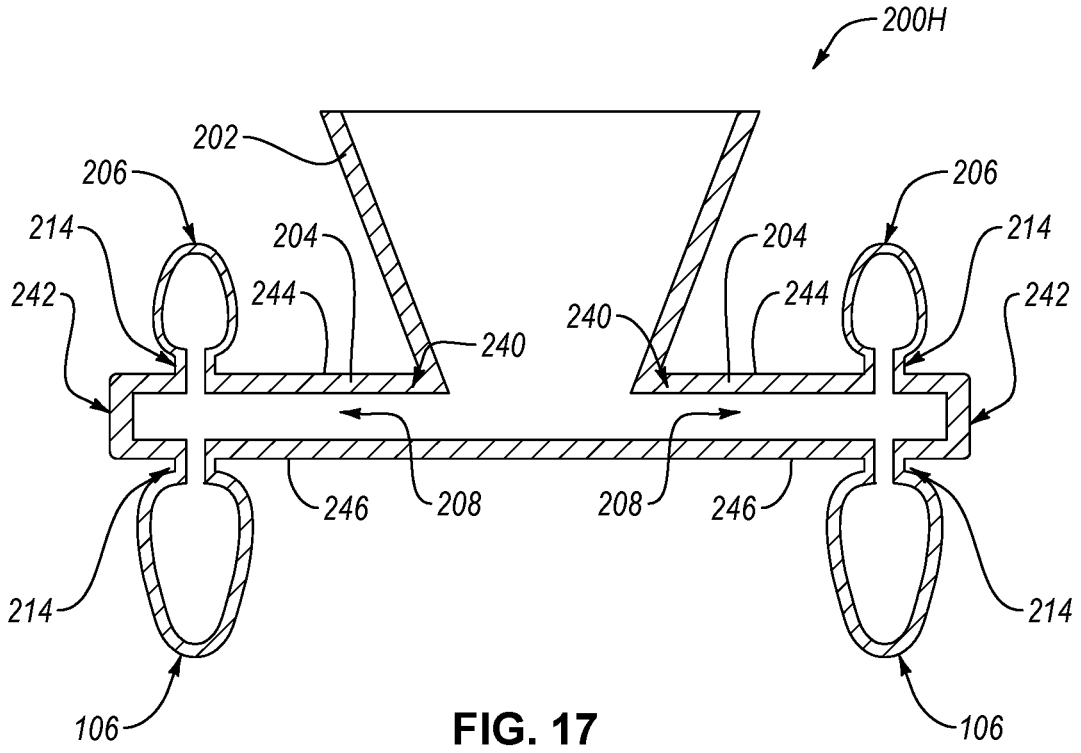
FIG. 17 is a cross-sectional side view of a casting cluster, according to one or more examples of the present disclosure.
Figure 18:
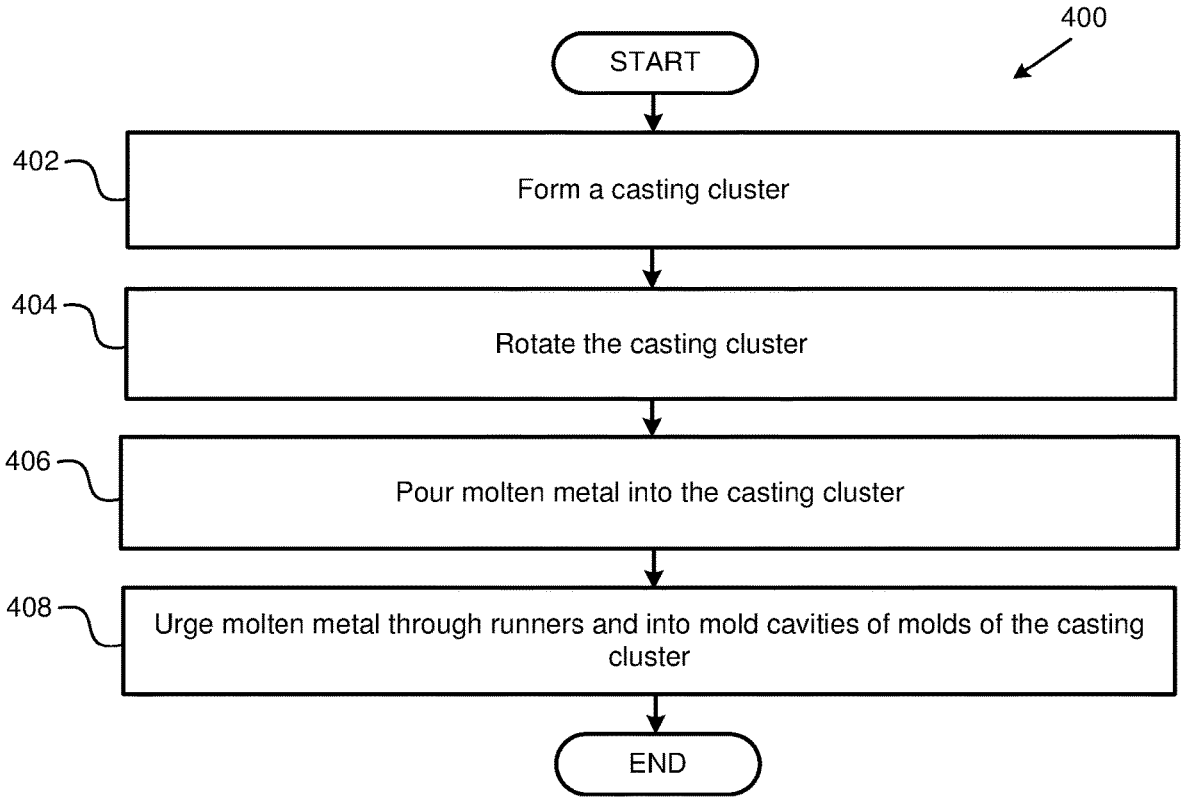
FIG. 18 is a schematic flow diagram of a method of casting multiple bodies of a golf club head, according to one or more examples of the present disclosure.

Referring to FIG. 17, another example of a casting cluster 200H is shown. The casting cluster 200H is similar to the casting cluster 200E of FIG. 14. For example, the casting cluster 200H includes a mold 206 at the bottom surface 246 of each runner 204 and a mold 206 at the top surface 244 of each runner 204. However, unlike the casting cluster 200E, the molds 106 of each runner 204 of the casting cluster 200H are differently configured (e.g., differently sized and/or differently shaped). In the illustrated example, the mold 206 at the bottom surface 246 of each runner 204 is larger than the mold 206 at the top surface 244 of each runner 204. As an example, one mold 106 of each runner 204 can be configured to cast a players-iron golf club head, with a smaller head and smaller strike face, and the other mold 106 of the runner 204 can be configured to cast a game-improvement-iron golf club head, with a larger head and larger strike face. As another example, one mold 106 of each runner 204 can be configured to cast a blade-type, muscle-back-type, or cavity-back-type iron golf club head and the other mold 106 of the runner 204 can be configured to cast a hollow-body-type iron golf club head.

Reference throughout this specification to "one embodiment," "an embodiment," or similar language means that a particular feature, structure, or characteristic described in connection with the embodiment is included in at least one embodiment of the present disclosure. Appearances of the phrases "in one embodiment," "in an embodiment," and similar language throughout this specification may, but do not necessarily, all refer to the same embodiment. Similarly, the use of the term "implementation" means an implementation having a particular feature, structure, or characteristic described in connection with one or more embodiments of the present disclosure, however, absent an express correlation to indicate otherwise, an implementation may be associated with one or more embodiments.

In the above description, certain terms may be used such as "up," "down," "upper," "lower," "horizontal," "vertical," "left," "right," "over," "under" and the like. These terms are used, where applicable, to provide some clarity of description when dealing with relative relationships. But, these terms are not intended to imply absolute relationships, positions, and/or orientations. For example, with respect to an object, an "upper" surface can become a "lower" surface simply by turning the object over. Nevertheless, it is still the same object. Further, the terms "including," "comprising," "having," and variations thereof mean "including but not limited to" unless expressly specified otherwise. An enumerated listing of items does not imply that any or all of the items are mutually exclusive and/or mutually inclusive, unless expressly specified otherwise. The terms "a," "an," and "the" also refer to "one or more" unless expressly specified otherwise. Further, the term "plurality" can be defined as "at least two." The term "about" in some embodiments, can be defined to mean within +/−5% of a given value.

Additionally, instances in this specification where one element is "coupled" to another element can include direct and indirect coupling. Direct coupling can be defined as one element coupled to and in some contact with another element. Indirect coupling can be defined as coupling between two elements not in direct contact with each other, but having one or more additional elements between the coupled elements. Further, as used herein, securing one element to another element can include direct securing and indirect securing. Additionally, as used herein, "adjacent" does not necessarily denote contact. For example, one element can be adjacent another element without being in contact with that element.

As used herein, the phrase "at least one of", when used with a list of items, means different combinations of one or more of the listed items may be used and only one of the items in the list may be needed. The item may be a particular object, thing, or category. In other words, "at least one of" means any combination of items or number of items may be used from the list, but not all of the items in the list may be required. For example, "at least one of item A, item B, and item C" may mean item A; item A and item B; item B; item A, item B, and item C; or item B and item C. In some cases, "at least one of item A, item B, and item C" may mean, for example, without limitation, two of item A, one of item B, and ten of item C; four of item B and seven of item C; or some other suitable combination.

Unless otherwise indicated, the terms "first," "second," etc. are used herein merely as labels, and are not intended to impose ordinal, positional, or hierarchical requirements on the items to which these terms refer. Moreover, reference to, e.g., a "second" item does not require or preclude the existence of, e.g., a "first" or lower-numbered item, and/or, e.g., a "third" or higher-numbered item.

As used herein, a system, apparatus, structure, article, element, component, or hardware "configured to" perform a specified function is indeed capable of performing the specified function without any alteration, rather than merely having potential to perform the specified function after further modification. In other words, the system, apparatus, structure, article, element, component, or hardware "configured to" perform a specified function is specifically selected, created, implemented, utilized, programmed, and/or designed for the purpose of performing the specified function. As used herein, "configured to" denotes existing characteristics of a system, apparatus, structure, article, element, component, or hardware which enable the system, apparatus, structure, article, element, component, or hardware to perform the specified function without further modification. For purposes of this disclosure, a system, apparatus, structure, article, element, component, or hardware described as being "configured to" perform a particular function may additionally or alternatively be described as being "adapted to" and/or as being "operative to" perform that function.

The present subject matter may be embodied in other specific forms without departing from its spirit or essential characteristics. The described embodiments are to be considered in all respects only as illustrative and not restrictive. All changes which come within the meaning and range of equivalency of the claims are to be embraced within their scope.

What is claimed is:

1. A casting cluster for casting a body of a golf club head made of titanium or a titanium alloy, the casting cluster comprising:

a receptor;

a plurality of runners coupled to the receptor and configured to receive molten metal from the receptor;

at least forty main gates, wherein at least two of the main gates are coupled to each of the runners and each main gate is configured to receive molten metal from a corresponding one of the plurality of runners; and at least forty molds, wherein:

at least two of the at least forty molds are coupled to each one of the plurality of runners via respective main gates of the at least forty main gates;

each mold of the at least forty molds is configured to receive molten metal from a corresponding one of the main gates; and each mold of the at least forty molds is configured to cast a body of an iron-type golf club head having a volume of no more than 80 $cm^3$.

2. The casting cluster according to claim 1, wherein the plurality of runners comprises at least sixteen runners.

3. The casting cluster according to claim 1, wherein:

each runner of the plurality of runners comprises a proximal end, adjacent the receptor, and a distal end, opposite the proximal end;

one main gate and one mold are coupled to the distal end of each of the plurality of runners; and at least one main gate and at least one mold are coupled to each of the plurality of runners between the proximal end and the distal end of the corresponding runner.

4. The casting cluster according to claim 3, wherein:

each runner of the plurality of runners comprises a top surface and a bottom surface, opposite the top surface; and the at least one main gate and the at least one mold coupled to each of the plurality of runners between the proximal end and the distal end are coupled to the bottom surface of the corresponding runner.

5. The casting cluster according to claim 4, wherein:

at least two main gates and at least two molds are coupled to each of the plurality of runners between the proximal end and the distal end of the corresponding runner;

one of the at least two main gates and one of the at least two molds are coupled to the bottom surface of the corresponding runner; and another one of the at least two main gates and another one of the at least two molds are coupled to the top surface of the corresponding runner.

6. The casting cluster according to claim 3, wherein:

each runner of the plurality of runners comprises a top surface and a bottom surface, opposite the top surface; and the at least one main gate and the at least one mold coupled to each of the plurality of runners at the location between the proximal end and the distal end are coupled to the top surface of the corresponding runner.

7. The casting cluster according to claim 1, wherein:

each runner of the plurality of runners comprises a proximal end, adjacent the receptor, and a distal end, opposite the proximal end; and at least two main gates and at least two molds are coupled to each of the plurality of runners between the proximal end and the distal end of the corresponding runner.

8. The casting cluster according to claim 7, wherein:

each runner of the plurality of runners comprises a top surface and a bottom surface, opposite the top surface;

one of the at least two main gates and one of the at least two molds are coupled to the bottom surface of the corresponding runner; and another one of the at least two main gates and another one of the at least two molds are coupled to the top surface of the corresponding runner.

9. The casting cluster according to claim 7, wherein:

each runner of the plurality of runners comprises a top surface and a bottom surface, opposite the top surface; and the at least two main gates and the at least two molds are coupled to the bottom surface of the corresponding runner.

10. The casting cluster according to claim 7, wherein:

each runner of the plurality of runners comprises a top surface and a bottom surface, opposite the top surface; and the at least two main gates and the at least two molds are coupled to the top surface of the corresponding runner.

11. The casting cluster according to claim 1, wherein:

one mold coupled to each of the plurality of runners is configured to cast a body having a first size or a first shape; and another mold coupled to each of the plurality of runners is configured to cast a body having a second size, different than the first size, or a second shape, different than the first shape.

12. The casting cluster according to claim 11, wherein:

the body having the first size corresponds with the body of a cavity-back type iron golf club head; and the body having the second size corresponds with the body of a hollow-body-type iron golf club head.

13. The casting cluster according to claim 11, wherein:

the body having the first size corresponds with the body of a players-iron-type golf club head; and the body having the second size corresponds with the body of a game-improvement-iron golf club head.

14. The casting cluster according to claim 1, wherein at least three of the main gates are coupled to each of a plurality of the runners.

15. The casting cluster according to claim 1, wherein:

the casting cluster further comprises at least forty-two main gates and at least forty-two molds; and at least two of the at least forty-two molds are coupled to each one of the plurality of runners via respective main gates of the at least forty-two main gates.

16. The casting cluster according to claim 15, wherein the plurality of runners comprises at least twenty-one runners.

17. The casting cluster according to claim 1, wherein:

the casting cluster further comprises at least fifty-two main gates and at least fifty-two molds; and at least two of the at least fifty-two molds are coupled to each one of the plurality of runners via respective main gates of the at least fifty-two main gates.

18. The casting cluster according to claim 17, wherein the plurality of runners comprises at least twenty-six runners.

19. The casting cluster according to claim 1, wherein each mold of the at least forty molds is configured to cast a body that has a mass of approximately 0.228 kilograms.

20. The casting cluster according to claim 1, wherein the casting cluster is configured to produce a cast-product yield of at least 80%.

21. The casting cluster according to claim 1, wherein each of the at least forty main gates and the corresponding runner, to which each of the at least forty main gates are coupled, have an interface gating ratio of approximately 1.3.

22. The casting cluster according to claim 1, wherein the body of the golf club head, cast by each mold, comprises an entirety of a face portion of the iron-type golf club head.

23. The casting cluster according to claim 1, wherein the body of the golf club head, cast by each mold, comprises only a portion of a face portion of the iron-type golf club head.

* * * * *